United States Patent [19]

Honda et al.

[11] Patent Number: 4,797,336

[45] Date of Patent: Jan. 10, 1989

[54] LIGHT RECEIVING MEMBERS HAVING A-SI(GE,SN) PHOTOSENSITIVE LAYER AND MULTI-LAYERED SURFACE LAYER CONTAINING REFLECTION PREVENTIVE LAYER AND ABRASION RESISTANT LAYER ON A SUPPORT HAVING SPHERICAL DIMPLES WITH INSIDE FACES HAVING MINUTE IRREGULARITIES

[75] Inventors: Mitsuru Honda; Atsushi Koike, both of Chiba; Kyosuke Ogawa, Miye; Keiichi Murai, Chiba, all of Japan

[73] Assignee: Canon Kabushiki Kaisha, Tokyo, Japan

[21] Appl. No.: 924,265

[22] Filed: Oct. 29, 1986

[30] Foreign Application Priority Data

Nov. 2, 1985 [JP] Japan ..... 60-246473

[51] Int. Cl.[4] ..... G03G 5/085

[52] U.S. Cl. ..... 430/57; 430/60; 430/64; 430/66; 430/69; 430/84

[58] Field of Search ..... 430/84, 950, 945, 57, 430/60, 64, 66, 69; 427/74

[56] References Cited

U.S. PATENT DOCUMENTS 4,352,847 10/1982 Okiyama ..... 430/950
4,514,582 4/1985 Tiedje et al. ..... 427/290
4,532,198 7/1985 Saitoh et al. ..... 427/74
4,599,482 7/1986 Yamazaki ..... 427/74
4,663,188 5/1987 Kane ..... 427/74

*Primary Examiner*—John L. Goodrow
*Attorney, Agent, or Firm*—Fitzpatrick, Cella, Harper & Scinto

[57] ABSTRACT

There is provided a light receiving member which comprises a support, a photosensitive layer composed of amorphous material containing silicon atoms and at least either germanium atoms or tin atoms and a surface layer, said surface layer being of multi-layered structure having at least an abrasion-resistant layer at the outermost side and a reflection preventive layer in the inside, and said support having a surface provided with irregularities composed of spherical dimples each of which having an inside face provided with minute irregularities. The light receiving member overcomes all of the problems in the conventional light receiving member comprising a light receiving layer composed of an amorphous silicon and, in particular, effectively prevents the occurrence of interference fringe in the formed images due to the interference phenomenon thereby forming visible images of excellent quality even in the case of using coherent laser beams possible producing interference as a light source.

35 Claims, 15 Drawing Sheets

(A)

(B)

(A)

(B)

LIGHT RECEIVING MEMBERS HAVING A-SI(GE,SN) PHOTOSENSITIVE LAYER AND MULTI-LAYERED SURFACE LAYER CONTAINING REFLECTION PREVENTIVE LAYER AND ABRASION RESISTANT LAYER ON A SUPPORT HAVING SPHERICAL DIMPLES WITH INSIDE FACES HAVING MINUTE IRREGULARITIES

BACKGROUND OF THE INVENTION

1. Field of the Invention

This invention concerns light receiving members being sensitive to electromagnetic waves such as light (which herein means in a broader sense those lights such as ultraviolet rays, visible rays, infrared rays, X-rays, and γ-rays). More specifically, the invention relates to improved light receiving members suitable particularly for use in the case where coherent lights such as laser beams are applied.

2. Description of the Prior Art

For the recording of digital image information, there has been known such a method as forming electrostatic latent images by optically scanning a light receiving member with laser beams modulated in accordance with the digital image information, and then developing the latent images or further applying transfer, fixing or like other treatment as required. Particularly, in the method of forming images by an Electrophotographic process, image recording has usually been conducted by using a He-Ne laser or a semiconductor laser (usually having emission wavelength at from 650 to 820 nm), which is small in size and inexpensive in cost as the laser source.

By the way, as the light receiving members for electrophotography being suitable for use in the case of using the semiconductor laser, those light receiving members comprising amorphous materials containing silicon atoms (hereinafter referred to as "a-Si"), for example, as disclosed in Japanese Patent Laid-Open Nos. 86341/1979 and 83746/1981, have been evaluated as being worthy of attention. They have a high Vickers hardness and cause less problems in the public pollution, in addition to their excellent matching property in the photosensitive region as compared with other kinds of known light receiving members.

However, when the light receiving layer constituting the light receiving member as described above is formed as an a-Si layer of mono-layer structure, it is necessary to structurally incorporate hydrogen or halogen atoms or, further, boron atoms within a range of specific amount into the layer in order to maintain the required dark resistance of greater than $10^{12}$ Ωcm as for the electrophotography while maintaining their high photosensitivity. Therefore, the degree of freedom for the design of the light receiving member undergoes a rather severe limit such as the requirement for the strict control for various kinds of conditions upon forming the layer. Then, there have been made several proposals to overcome such problems for the degree of freedom in view of the design in that the high photosensitivity can effectively be utilized while reducing the dark resistance to some extent. That is, the light receiving layer is so constituted as to have two or more layers prepared by laminating those layers for different conductivity in which a depletion layer is formed to the inside of the light receiving layer as disclosed in Japanese Patent Laid-Open Nos. 171743/1979, 4053/1982, and 4172/1982, or the apparent dark resistance is improved by providing a multi-layered structure in which a barrier layer is disposed between the support and the light receiving layer and/or on the upper surface of the light receiving layer as disclosed, for example, in Japanese Patent Laid-Open Nos. 52178/1982, 52179/1982, 52180/1982, 58159/1982, 58160/1982, and 58161/1982.

However, such light receiving members as having a light receiving layer of multi-layered structure have unevenness in the thickness for each of the layers. In the case of conducting the laser recording by using such members, since the laser beams comprise coherent monochromatic light, the respective light beams reflected from the free surface of the light receiving layer on the side of the laser beam irradiation and from the layer boundary between each of the layers constituting the light receiving layer and between the support and the light receiving layer (hereinafter both of the free surface and the layer interface are collectively referred to as "interface") often interfere with each other.

The interference results in a so-called interference fringe pattern in th.e formed images which brings about defective image. Particularly, in the case of intermediate tone images with high gradation, the images obtained become extremely poor in quality.

In addition, as an important point there exist problems that the foregoing interference phenomenon will become remarkable due to that the absorption of the laser beams in the light receiving layer is decreased as the wavelength region of the semiconductor laser beams used is increased.

That is, in the case of two or more layer (multi-layered) structure, interference effects occur as for each of the layers, and those interference effects are synergistically acted with each other to exhibit interference fringe patterns, which directly influence on the transfer member thereby to transfer and fix the interference fringe on the member, and thus bringing about defective images in the visible images corresponding to the interference fringe pattern.

In order to overcome these problems, there have been proposed, for example, (a) a method of cutting the surface of the support with diamond means to form a light scattering surface formed with unevenness of ±500 Å to ±10,000 Å (refer, for example, to Japanese Patent Laid-Open No. 162975/1983), (b) a method of disposing a light absorbing layer by treating the surface of an aluminum support with black alumite or by dispersing carbon, colored pigment, or dye into a resin (refer, for example, to Japanese Patent Laid-Open No. 165845/1982), and (c) a method of disposing a light scattering reflection preventing layer on an aluminum support by treating the surface of the support with a satin-like alumite processing or by disposing a fine grain-like unevenness by means of sand blasting (refer, for example, to Japanese Patent Laid-Open No. 16554/1982).

Although these proposed methods provide satisfactory results to some extent, they are not sufficient for completely eliminating the interference fringe pattern which forms in the images.

That is, in the method (a), since a plurality of irregularities with a specific thickness are formed at the surface of the support, occurrence of the interference fringe pattern due to the light scattering effect can be prevented to some extent. However, since the regular reflection light component is still left as the light scattering, the interference fringe pattern due to the regular reflection light still remains and, in addition, the irradiation spot is widened due to the light scattering effect at the support surface to result in a substantial reduction in the resolving power.

In the method (b), it is impossible to obtain complete absorption only by the black alumite treatment, and the reflection light still remain at the support surface. And in the case of disposing the resin layer dispersed with the pigment, there are various problems; degasification is caused from the resin layer upon forming an a-Si layer to invite a remarkable deterioration on the quality of the resulting light receiving layer: the resin layer is damaged by the plasmas upon forming the a-Si layer wherein the inherent absorbing function is reduced and undesired effects are given to the subsequent formation of the a-Si layer due to the worsening in the surface state.

In the method (c), referring to incident light for instance, a portion of the incident light is reflected at the surface of the light receiving layer to be a reflected light, while the remaining portion intrudes as the transmitted light to the inside of the light receiving layer. And a portion of the transmitted light is scattered as a diffused light at the surface of the support and the remaining portion is regularly reflected as a reflected light, a portion of which goes out as the outgoing light. However, the outgoing light is a component to interfere with the reflected light. In any event, since the light remains, the interference fringe pattern cannot be completely eliminated.

For preventing the interference in this case, attempts have been made to increase the diffusibility at the surface of the support so that no multi-reflection occurs at the inside of the light receiving layer. However, this somewhat diffuses the light in the light receiving layer thereby causing halation and, accordingly, all, reducing the resolving power.

Particularly, in the light receiving member of the multi-layered structure, if the support surface is roughened irregularly, the reflected light at the surface of the first layer, the reflected light at the second layer, and the regular reflected light at the support surface interfere with one another which results in the interference fringe pattern in accordance with the thickness of each layer in the light receiving member. Accordingly, it is impossible to completely prevent the interference fringe by unevenly roughening the surface of the support in the light receiving member of the multi-layered structure.

In the case of unevenly roughening the surface of the support by sand blasting or like other method, the surface roughness varies from one lot to another and the unevenness in the roughness occurs even in the same lot thereby causing problems in view of the production control. In addition, relatively large protrusions are frequently formed at random and such large protrusions cause local breakdown in the light receiving layer.

Further, even if the surface of the support is regularly roughened, since the light receiving layer is usually deposited along the uneven shape at the surface of the support, the inclined surface on the unevenness at the support are in parallel with the inclined surface on the unevenness at the light receiving layer, where the incident light brings about bright and dark areas. Further, in the light receiving layer, since the layer thickness is not uniform over the entire light receiving layer, a dark and bright stripe pattern occurs. Accordingly, mere orderly roughening the surface of the support cannot completely prevent the occurrence of the interference fringe pattern.

Furthermore, in the case of depositing the light receiving layer of multi-layered structure on the support having the surface which is regularly roughened, since the interference due to the reflected light at the interface between the layers is joined to the interference between the regular reflected light at the surface of the support and the reflected light at the surface of the light receiving layer, the situation is more complicated than the occurrence of the interference fringe in the light receiving member of single layer structure.

SUMMARY OF THE INVENTION

The object of this invention is to provide a light receiving member comprising a light receiving layer mainly composed of a-Si, free from the foregoing problems and capable of satisfying various kinds of requirements.

That is, the main object of this invention is to provide a light receiving member comprising a light receiving layer constituted with a-Si in which electrical, physical, and photoconductive properties are always substantially stable scarcely depending on the working circumstances, and which is excellent against optical fatigue, cause no degradation upon repeating use, excellent in durability and moisture-proofness, exhibits no or scarely any residual potential and provides easy production control.

Another object of this invention is to provide a light receiving member comprising a light receiving layer composed of a-Si which has a high photosensitivity in the entire visible region of light, particularly, an excellent matching property with a semiconductor laser, and shows quick light response.

Other object of this invention is to provide a light receiving member comprising a light receiving layer composed of a-Si which has high photosensitivity, high S/N ratio, and high electrical voltage withstanding property.

A further object of this invention is to provide a light receiving member comprising a light receiving layer composed of a-Si which is excellent in the close bondability between the support and the layer disposed on the support or between the laminated layers,strict and stable in that of the structural arrangement and of high layer quality.

A further object of this invention is to provide a light receiving member comprising a light receiving layer composed of a-Si which is suitable to the image formation by using a-Si which is suitable to the image formation by using coherent light, free from the occurrence of interference fringe pattern and spot upon reversed development even after repeating use for a long period of time, free from defective images or blurring in the images, shows high density with clear half tone, and has a high resolving power, and can provide high quality images.

These and other objects, as well as the features of this invention will become apparent by reading the following descriptions of preferred embodiments according to this invention while referring to the accompanying drawings.

BRIEF DESCRIPTION OF THE DRAWINGS

FIGS. 2 and 3 are enlarged portion views for a portion illustrating the principle of preventing the occurrence of interference fringe in the light receiving member according to this invention, in which FIG. 2 is a view illustrating that the occurrence of the interference fringe can be prevented in the light receiving member in which unevenness constituted with spherical dimples is formed to the surface of the support, and FIG. 3 is a view illustrating that the interference fringe occurs in the conventional light receiving member in which the light receiving layer is deposited on the support roughened regularly at the surface.

FIGS. 6(A) and 6(B) are charts schematically illustrating a constitutional example of a device suitable for forming the uneven shape formed to the support of the light receiving member according to this invention, in which FIG. 6(A) is a front elevational view, and FIG. 6(B) is a vertical cross-sectional view.

DETAILED DESCRIPTION OF THE INVENTION

The present inventors have made earnest studies for overcoming the foregoing problems on the conventional light receiving members and attaining the objects as described above and, as a result, have accomplished this invention based on the findings as described below.

That is, this invention relates to a light receiving member which is characterized by comprising a support and a light receiving layer having a photosensitive layer composed of amorphous material containing silicon atoms and at least either germanium atoms or tin atoms and a surface layer, said surface layer being of multi-layered structure having at least an abrasion-resistant layer at the outermost side and a reflection preventive layer in the inside, and said support having a surface provided with irregularities composed of spherical dimples each of which having an inside face provided with minute irregularities.

Incidentally, the findings that the present inventors obtained after earnest studies are as follows;

That is, one finding is that in a light receiving member equipped with a light receiving layer having a photosensitive layer and a surface layer on a support (substrate), when the surface layer is constituted as a multi-layered structure having an abrasion-resistant layer at the outermost side and at least a reflection preventive layer in the side, the reflection of the incident light at the interface between the surface layer and the photosensitive layer can be prevented, and the problems such as the interference fringe or uneven sensitivity resulted from the uneven layer thickness upon forming the surface layer and/or uneven layer thickness due to the abrasion of the surface layer can be overcome.

Another finding is that the problems for the interference fringe pattern occurring upon image formation in the light receiving member having a plurality of layers on a support can be overcome by disposing unevenness constituted with a plurality of spherical dimples each of which having an inside face provided with minute irregularities on the surface of the support.

Now, these findings are based on the facts obtained by various experiments which were carried out by the present inventors.

To help understand the foregoing, the following explanation will be made with reference to the drawings.

Figure 1:
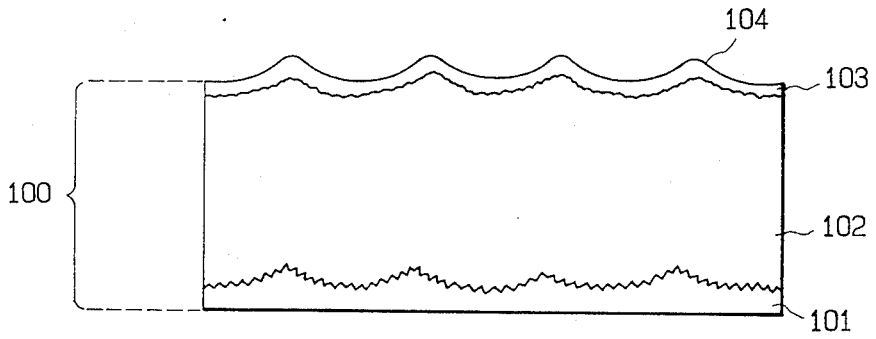
FIG. 1 is a view of schematically illustrating a typical example of the light receiving members according to this invention.

FIG. 1 is a schematic view illustrating the layer structure of the light receiving member 100 pertaining to this invention. The light receiving member is made up of the support 101, a photosensitive layer 102 and a surface layer 103 respectively formed thereon. The support 101 has a support surface provided with irregularities composed of a plurality of fine spherical dimples each of which having an inside face provided with minute irregularities. The photosensitive layer 102 and the surface layer 103 are formed along the slopes of the irregularities.

Figure 2:
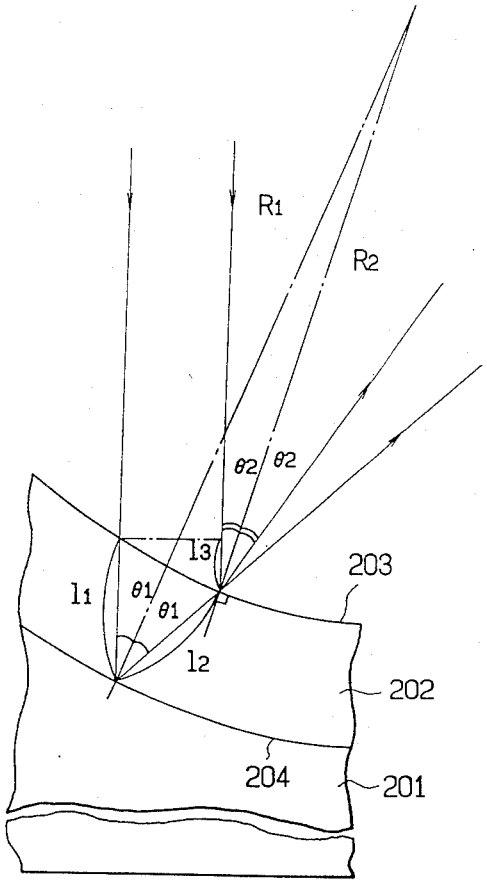
Figure 3:
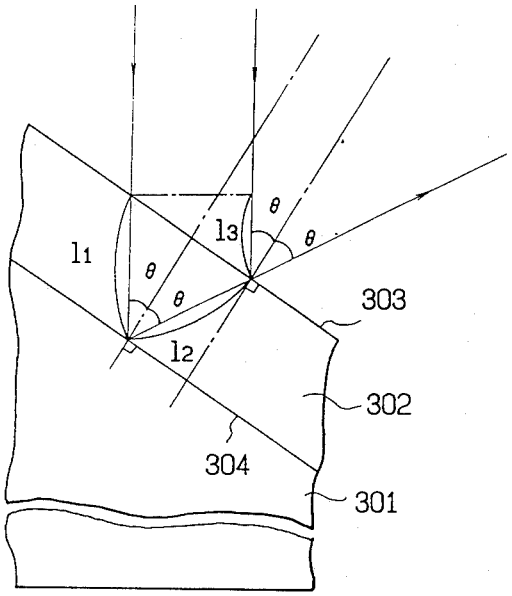

FIGS. 2 and 3 are views explaining how the problem of interference infringe pattern is solved in the light receiving member of this invention.

FIG. 3 is an enlarged view for a portion of a conventional light receiving member in which a light receiving layer of a multi-layered structure is deposited on the support, the surface of which is regularly roughened. In the drawing, 301 is a photosensitive layer, 302 is a surface layer, 303 is a free surface and 304 is an interface between the photosensitive layer and the surface layer. As shown in FIG. 3, in the case of merely roughening the surface of the support regularly by grinding or like other means, since the light receiving layer is usually formed along the uneven shape at the surface of the support, the slope of the unevenness at the surface of the support and the slope of the unevenness of the light receiving layer are in parallel with each other.

Owing to the parallelism, the following problems always occur, for example, in a light receiving member of multilayered structure in which the light receiving layer comprises two layers, that is, the photosensitive layer 301 and the surface layer 302. Since the interface 304 between the photosensitive layer and the surface layer is in parallel with the free surface 303, the direction of the reflected light $R_1$ at the interface 304 and that of the reflected light $R_2$ at the free surface coincide with each other and, accordingly, an interference fringe occurs depending on the thickness of the surface layer.

FIG. 2 is an enlarged view for a portion shown in FIG. 1. As shown in FIG. 2, an uneven shape composed of a plurality of fine spherical dimples each of which having an inside face provided with minute irregularities (not shown) are formed at the surface of the support in the light receiving member according to this invention and the light receiving layer thereover is deposited along the uneven shape. Therefore, in the light receiving member of the multi-layered structure, for example, in which the light receiving layer comprises a photosensitive layer 201 and a surface layer 202, the interface 204 between the photosensitive layer 201 and the surface layer 202 and the free surface 203 are respectively formed with the uneven shape composed of the spherical dimples along the uneven shape at the surface of the support. Assuming the radius of curvature of the spherical dimples formed at the interface 204 as $R_1$ and the radius of curvature of the spherical dimples formed at the free surface as $R_2$, since $R_1$ is not identical with $R_2$, the reflection light at the interface 204 and the reflection light at the free surface 203 have reflection angles different from each other, that is $\theta_1$ is not identical with $\theta_2$ in FIG. 2 and the direction of their reflection lights are different. In addition, the deviation of the wavelength represented by $l_1+l_2-l_3$ by using $l_1$, $l_2$, and $l_3$ shown in FIG. 2 is not constant but variable, by which a sharing interference corresponding to the so-called Newton ring phenomenon occurs and the interference fringe is dispersed. within the dimples. Then, if the interference ring should appear in the microscopic point of view in the images caused by way of the light receiving member, it is not visually recognized.

That is, in a light receiving member having a light receiving layer of multi-layered structure formed on the support having such a surface shape, the fringe pattern resulted in the images due to the interference between lights passing through the light receiving layer and reflecting on the layer interface and at the surface of the support thereby enabling to obtain a light receiving member capable of forming excellent images.

Figure 4:
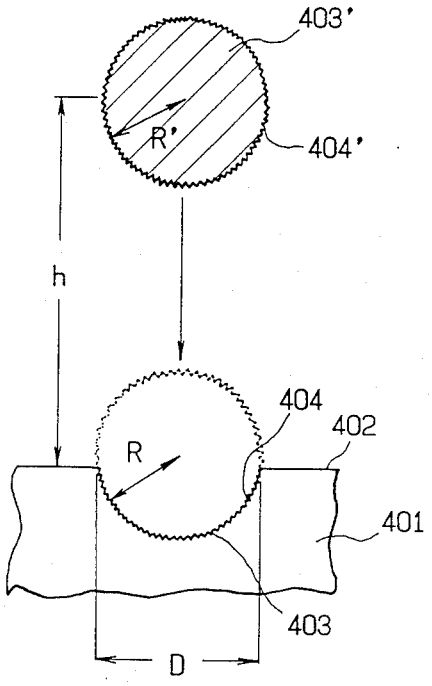
FIGS. 4, 5(A), 5(B) and 5(C) are schematic views for illustrating the uneven shape at the surface of the support of the light receiving member according to this invention and a method of preparing the uneven shape.

In addition, when the spherical dimple at the support surface is so formed to have an inside face provided with minute irregularities in the way as shown in FIG. 4 which is a schematic view for a typical example of the shape at the support surface in the light receiving member according to this invention shown in FIG. 1, in which a portion of the uneven shape is enlarged and are shown a support 401 and a support surface 402 composed of a spherical dimple 403 having an inside surface provided with minute irregularities 404, 404, . . . , desirable scattering effects are brought about due to the minute irregularities in addition to the interference preventive effect as above explained referring to FIG. 2 thereby the occurrence of an interference fringe pattern being more certainly prevented, and the following problems which are observed for the conventional light receiving members are effectively eliminated.

Namely, in the conventional technique, the occurrence of an interference fringe pattern is prevented by merely roughening the support surface as above explained. However, in that case, a sufficient effect of preventing the occurrence of an interference fringe pattern is not given, and other problems are often brought about particularly when the cleaning process after the image transference is carried out with the use of a blade. That is, since the light receiving layer is formed along the uneven shape at the support surface to be of such having an uneven surface shape following the uneven shape of the support surface, the blade collides mainly against a convex part of the uneven surface shape of the light receiving layer to cause problems that cleaning is not perfected and not only an abrasion of the convex part of the light receiving layer but also that of the surface of the blade becomes greater thereby their durabilities being decreased.

By the way, the radius of curvature R and the width D of the uneven shape formed by the spherical dimples, at the surface of the support of the light receiving member according to this invention constitute an important factor for effectively attaining the advantageous effects of preventing the occurrence of the interference fringe in the light receiving member according to this invention.

The present inventors carried out.various experiments and, as a result, found the following facts.

That is, if the radius of curvature R and the width D satisfy the following equation:

$$D/R \geqq 0.035$$

0.5 or more Newton rings due to the sharing interference are present in each of the dimples. Further, if they satisfy the following equation:

$$D/R \geqq 0.055$$

one or more Newton rings due to the sharing interference are present in each of the dimples.

From the foregoing, it is preferred that the ratio D/R is greater than 0.035 and, preferably, greater than 0.055 for dispersing the interference fringes resulted throughout the light receiving member in each of the dimples thereby preventing the occurrence of the interference fringe in the light receiving member.

Further, it is desired that the width D of the uevenness formed by the scraped dimple is about 500 μm at the maximum, preferably, less than 200 μm and, more preferably less than 100 μm.

In addition, it is desired that the height of a minute irregularity to be formed with the inside face of a spherical dimple of the support, namely the surface roughness $\gamma_{max}$ of the inside fce of the spherical dimple lies in the range of 0.5 to 20 μm. That is, in the case where said $\gamma_{max}$ is less than 0.5 μm, a sufficient scattering effect is not be given. And in the case where it exceeds 20 μm, the magnitude of the minute irregularity becomes undesirably greater in comparison with that of the spherical dimple to prevent the spherical dimple from being formed in a desired spherical form and result in bringing about such a light receiving member that does not prevent sufficiently the occurrence of the interference fringe. In addition to this, when a light receiving layer is deposited on such support, the light receiving member as prepared becomes to have such a light receiving layer that is accompanied by an undesirably grown unevenness being apt to invite defects in visible images to be formed.

This invention has been completed on the basis of the above-mentioned findings.

The light receiving layer of the light receiving member which is disposed on the surface having the particular surface as above-mentioned in this invention is constituted by the photosensitive layer and the surface layer. The photosensitive layer is composed of amorphous materia containing silicon atoms and at least either germanium atoms or tin atoms, particularly preferably, of amorphous material containing silicon atoms(Si), at least either germanium atoms(Ge) or tin atoms(Sn), and at least either hydrogen atoms (H) or halogen atoms(X) [hereinafter referred to as "a-Si(Ge,Sn) (H,X)"] or of a-Si(Ge,Sn)(H,X) containing at least one kind selected from oxygen atoms(O), carbon atoms(C) and nitrogen atoms(N) [hereinafter referred to as "a-Si(Ge,Sn)(O,C,N)(H,X)"]. And said amorphous materials may contain one or more kinds of substances to control the conductivity in the case where necessary.

And, the photosensitive layer may be of a multi-layered structure and, particularly preferably it includes a charge injection inhibition layer containing a substance to control the conductivity as one of the constituent layers and/or a barrier layer as one of the constituent layers.

The surface layer may be composed of amorphous mateiral containing silicon atoms, at least one kind selected from oxygen atoms(O), carbon atoms(C) and nitrogen atoms(N) and, preferably in addition to these, at least either hydrogen atoms(H) or halogen atoms(X) [hereinafter referred to as "a-Si(O,C,N)(H,X)"], or may be composed of at least one kind selected from inorganic fluorides, inorganic oxides and inorganic sulfides. And in any case of the above alternatives, the surface layer is multi-layered to have at least an abrasion-resistant layer at the outermost side and a refection preventive layer in the inside.

For the preparation of the photosensitive layer and the surface layer of the light receiving member according to this invention, because of the necessity of precisely controlling their thicknesses at an optical level in order to effectively achieve the foregoing objects of this invention there is usually used vacuum deposition technique such as glow discharging method, sputtering method or ion plating method, but other than these methods, optical CVD method and heat CVD method may be also employed.

The light receiving member according to this invention will now be explained more specifically referring to the drawings. The description is not intended to limit the scope of the invention.

Support

The support 101 in the light receiving member according to this invention has a surface with fine unevenness smaller than the resolution power required for the light receiving member and the unevenness is composed of a plurality of spherical dimples each of which having an inside face provided with minute irregularities.

Figure 5:
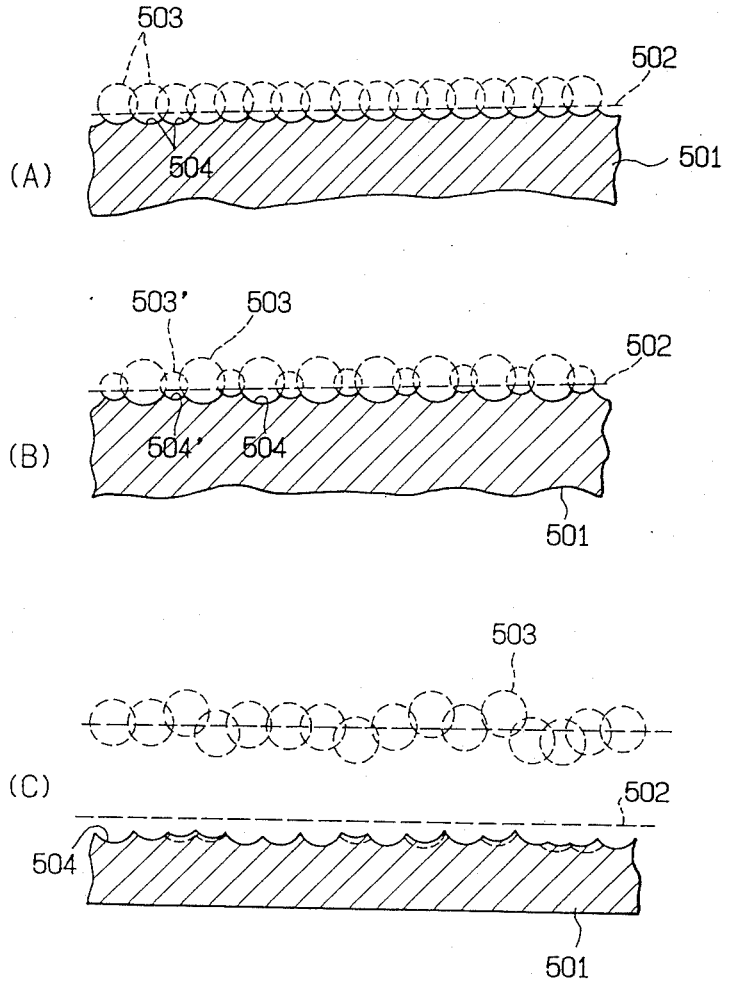

The shape of the surface of the support and an example of the preferred methods of preparing the shape are specifically explained referring to FIGS. 4 and 5 but it should be noted that the shape of the support in the light receiving member of this invention adn the method of preparing the same are no way limited only thereto.

FIG. 4 is a schematic view for a typical example of the shape at the surface of the support in the light receiving member according to this invention, in which a portion of the uneven shape is enlarged.

In FIG. 4, are shown a support 401, a support surface 402, an irregular shape due to a spherical dimple (spherical cavity pit) 403, an inside face of the spherical dimple provided with minute irregularities 404, and a rigid sphere 403' of which surface has irregularities 404'.

FIG. 4 also shows an example of the preferred methods of preparing the surface shape of the support. That is, the rigid sphere 403' is caused to fall gravitationally from a position at a predetermined height above the support surface 402 and collides against the support surface 402 thereby forming tee spherical dimple having the inside face provided with minute irregularities 404. And a plurality of the spherical dimples 403 each substantially of an almost identical radius of curvature R and of an almost identical width D can be formed to the support surface 402 by causing a plurality of the rigid spheres 403' substantially of an identical diameter of curvature R' to fall from identical height h simultaneously or sequentially.

FIGS. 5(A) through 5(C) show typical embodiments of supports formed with the uneven shape composed of a plurality of spherical dimples each of which having an inside surface provided with minute irregularities at the surface as described above.

In FIGS. 5(A) through 5(C), are shown a support 501, a support surface 502, a spherical dimple (spherical cavity pit) having an inside face provided with minute irregularities (not shown) 504 or 504' and a rigid.sphere of which surface has minute irregularities (not shown) 503 or 503'.

In the embodiment shown in FIG. 5(A), a plurality of dimples (spherical cavity pits) 503, 503, . . . of an almost identical radius of curvature and of an almost identical width are formed while being closely overlapped with each other thereby forming an uneven shape regularly by causing to fall a plurality of spheres 503', 503', . . . regularly from an identical height to different positions at the support surface 502 of the support 501. In this case, it is naturally required for forming the dimples 503, 503, . . . overlapped with each other that the spheres 503', 503', . . . are gravitationally dropped such that the times of collision of the respective spheres 503', 503', . . . to the support surface 502 are displaced from each other.

Further, in the embodiment shown in FIG. 5(B), a plurality of dimples 504, 504', . . . having two kinds of diameter of curvature and two kinds of width are formed being densely overlapped with each other to the surface 502 of the support 501 thereby forming an unevenness with irregular height at the surface by dropping two kinds of spheres 503, 503', . . . of different diameters from the heights identical with or different from each other.

Furthermore, in the embodiment shown in FIG. 5(C) (front elevational and cross-sectional views for the support surface), a plurality of dimples 504, 504, . . . of an almost identical diameter of curvature and plural kinds of width are formed while being overlapped with each other thereby forming an irregular unevenness by causing to fall a plurality of spheres 503, 503, . . . of an identical diameter from the identical height irregularly to the surface 502 of the support 501.

As described above, the uneven shape of the support surface composed of the spherical dimples each of which having an inside face provided with irregularities can be formed preferably by dropping the rigid spheres respectively of a surface provided with minute irregularities to the support surface. In this case, a plurality of spherical dimples having desired radius of curvature and width can be formed at a predetermined density on the support surface by properly selecting various conditions such as the diameter of the rigid spheres, falling height, hardness for the rigid sphere and the support surface or the amount of the fallen spheres. That is, the height and the pitch of the uneven shape formed for the support surface can optionally be adjusted depending on the given purpose by selecting various conditions as described above thereby enabling to obtain a support having a desired uneven shape with the support surface.

For making the surface of the support into an uneven shape in the light receiving member, a method of forming such a shape by the grinding work by means of a diamond cutting tool using lathe, milling cutter, etc. has been proposed, which will be effective to some extent. However, the method leads to problems in that it requires to use cutting oils, remove cutting dusts inevitably resulted during cutting work and to remove the cutting oils remaining on the cut surface, which after all complicates the fabrication and reduce the working efficiency. In this invention, since the uneven surface shape of the support is formed by the spherical dimples as described above, a support having the surface with a desired uneven shape can conveniently be prepared with no problems as described above at all.

The support 101 for use in this invention may either be electroconductive or insulative. The electroconductive support can include, for example, metals such as NiCr, stainless steels, Al, Cr, Mo, Au, Nb, Ta, V, Ti, Pt and Pb or the alloys thereof.

The electrically insulative support can include, for example, films or sheets of synthetic resins such as polyester, polyethylene, polycarbonate, cellulose acetate, polypropylene, polyvinyl chloride, polyvinylidene chloride, polystyrene, and polyamide, glass, ceramic and paper. It is preferred that the electrically insulative support is applied with electroconductive treatment to at least one of the surfaces thereof and disposed with a light receiving layer on the thus treated surface.

In the case of glass, for instance, electroconductivity is applied by disposing, at the surface thereof, a thin film made of NiCr, Al, Cr, Mo, Au, Ir, Nb, Ta, V, Ti, Pt, Pd, $In_2O_3$, $SnO_2$, ITO ($In_2O_3+SnO_2$), etc. In the case of the synthetic resin film such as a polyester film, the electroconductivity is provided to the surface by disposing a thin film of metal such as NiCr, Al, Ag, Pv, Zn, Ni, Au, Cr, Mo, Ir, Nb, Ta, V, Tl and Pt by means of vacuum deposition, electron beam vapor deposition, sputtering, etc. or applying lamination with the metal to the surface. The support may be of any configuration such as cylindrical, belt-like shape, which can be properly determined depending on the application uses. For instance, in the case of using the light receiving member as shown in FIG. 1 as image forming member for use in electronic photography, it is desirably configurated into an endless belt or cylindrical form in the case of continuous high speed reproduction. The thickness of the support member is properly determined so that the light receiving member as desired can be formed. In the case flexibility is required for the light receiving member, it can be made as thin as possible within a range capable of sufficiently providing the function as the support. However, the thickness is usually greater than 10 μm in view of the fabrication and handling or mechanical strength of the support.

Figure 6:
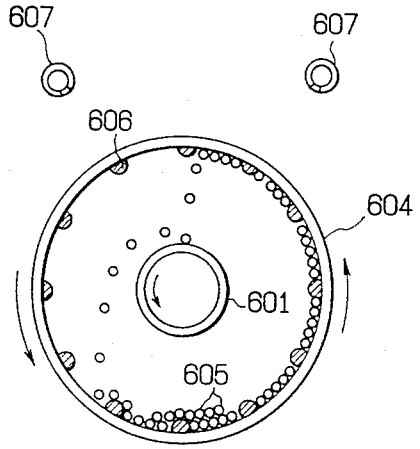
Figure 6:
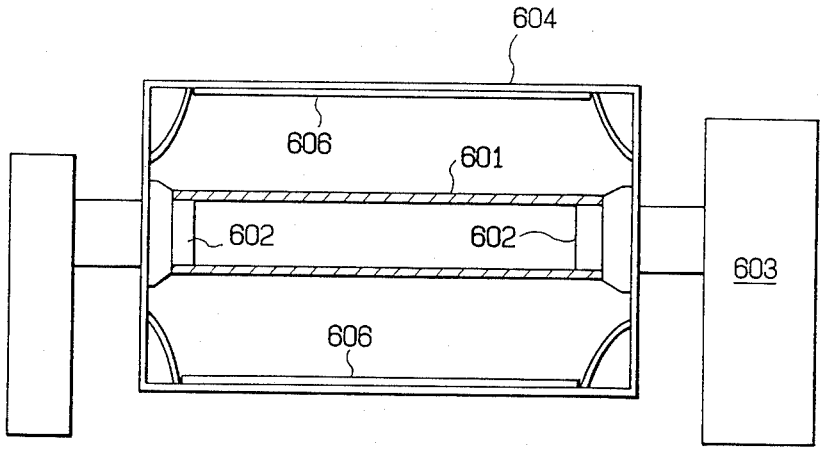

Explanation will then be made to one embodiment of a device for preparing the support surface in the case of using the light receiving member according to this invention as the light receiving member for use in electronic photography while referring to FIGS. 6(A) and 6(B), but this invention is no way limited only thereto.

In the case of the support for the light receiving member for use in electronic photography, a cylindrical substrate is prepared as a drawn tube obtained by applying usual extruding work to aluminum alloy or the like other material into a boat hall tube or a mandrel tube and further applying drawing work, followed by optical heat treatment or tempering. Then, an uneven shape is formed at the surface of the support as the cylindrical substrate by using the fabrication device as shown in FIG. 6(A) and 6(B). The rigid sphere to be used for forming the uneven shape as described above at the support surface can include, for example, various kinds of rigid spheres made of stainless steels, aluminum, steels, nickel and brass and like other metals, ceramics and plastics. Axong all, rigid spheres of stainless steels or steels are preferred in view of the durability and the reduced cost. The hardness of such sphere may be higher or lower than that of the support.

However, in the case of using the rigid sphere repeatedly used, it is desired that the hardness is higher than that of the support.

In order to form the particular shape as above mentioned for the support surface, it is necessary to use a rigid sphere of a surface provided with minute irregularities.

Such rigid sphere may be prepared properly in accordance with a mechanical treatment method such as a method utilizing plastic processing treatment such as embossing and wave adding and a surface roughening method such as sating finishing or a chemical treatment method such as acid etching or alkali etching.

And the shape (height) or the hardness of the irregularities as formed on the surface of the rigid sphere may be adjusted properly by subjecting the rigid sphere to the surface treatment in accordance with electropolishing, chemical polishing or finish polishing, or anodic oxidation coating, chemical coating, planting, vitreous enameling, painting, evaporation film forming or CVD film forming.

FIGS. 6(A) and 6(B) are schematic cross-sectional views for the entire fabrication device, in which are shown an aluminum cylinder 601 for preparing a support, and the cylinder 601 may previously be finished at the surface to an appropriate smoothness. The cylinder 601 is supported by a rotating shaft 602, driven by an appropriate drive means 603 such as a motor and made rotatable around the axial center. The rotating speed is properly determined and controlled while considering the density of the spherical dimples to be formed and the amount of rigid spheres supplied.

A rotating vessel 604 is supported by the rotating shaft 602 and rotates in the same direction as the cylinder 601 does. The rotating vessel 604 contains a plurality of rigid spheres each of which having a surface provided with minute irregularities 605, 605, . . . The rigid spheres are held by plural projected ribs 606, 606, . . . being disposed on the inner wall of the rotating vessel 604 and transported to the upper position by the rotating action of the rotating vessel 604. The rigid spheres 605, 605, . . . then continuously fall down and collide against the surface of the cylinder 601 thereby forming a plurality of spherical dimples each of which having an inside face provided with irregularities when the revolution speed of the rotating vessel 605 is maintained at an appropriate rate.

The fabrication device can be structured in the following way. That is, the circumferential wall of the rotating vessel 604 are uniformly perforated so as to lllow the passage of a washing liquid to be jetting-like supplied from one or more of a showering pipe 607 being placed outside the rotating vessel 604 thereby having the cylinder 601, the rigid spheres 605, 605, . . .

and also the inside of the rotating vessel 604 washed with the washing liquid.

In that case, extraneous matter caused due to a static electricity generated by contacts between the rigid spheres or between the rigid spheres and the inside part of the rotating vessel can be washed away to form a desirable shape to the surface of the cylinder being free from such extraneous matter. As the washing liquid, it is necessary to use such that does not give any dry unevenness or any residue. In this respect, a fixed oil itself or a mixture of it with a washing liquid such as trichloroethane or trichloroethylene are preferable.

Photosensitive Layer

In the light receiving member of this invention, the photosensitive layer 102 is disposed on the above-mentioned support. The photosensitive layer is composed of a-Si(Ge,Sn) (H,X) or a-Si(Ge,Sn)(O,C,N)(H,X), and preferably it contains a substance to control the conductivity.

The halogen atom(X) contained in the photosensitive layer include, specifically, fluorine, chlorine, bromine, and iodine, fluorine and chlorine being particularly preferred. The amount of the hydrogen atoms(H), the axount of the halogen atoms(X) or the sum of the amounts for the hydrogen atoms and the halogen atoms (H+X) contained in the photosensitive layer 102 is usually from 1 to 40 atomic % and, preferably, from 5 to 30 atomic %.

In the light receiving member according to this invention, the thickness of the photosensitive layer is one of the important factors for effectively attaining the objects of this invention and a sufficient care should be taken therefor upon designing the light receiving member so as to provide the member with desired performance. The layer thickness is usually from 1 to 100 μm, preferably from 1 to 80 μm and, more preferably, from 2 to 50 μm.

Now, the purpose of incorporating germanium atoms and/or tin atoms in the photosensitive layer of the light receiving member according to this invention is chiefly for the improvement of an absorption spectrum property in the long wavelength region of the light receiving member.

That is, the light receiving member according to this invention becomes to give excellent various properties by incorporating germanium atoms and/or tin atoms in the photosensitive layer. Particularly, it becomes more sensitive to light of wavelengths broadly ranging from short wavelength to long wavelength covering visible light and it also becomes quickly responsive to light.

This effect becomes more significant when a semiconductor laser emitting ray is used as the light source.

In the photosensitive layer of the light receiving member according to this invention, it may contain germanium atoms and/or tin atoms either in the entire layer region or in the partial layer region adjacent to the support.

In the latter case, the photosensitive layer becomes to have a layer constitution that a constituent layer containing germanium atoms and/or tin atoms and another constituent layer containing neither germanium atoms nor tin atoms are laminated in this order from the side of the support.

And either in the case where germanium atoms and/or tin atoms are incorporated in the entire layer region or in the case where incorporated only in the partial layer region, germanium atoms and/or tin atoms may be distributed therein either uniformly or unevenly. (The uniform distribution means that the distribution of germanium atoms and/or tin atoms in the photosensitive layer is uniform both in the direction parallel with the surface of the support and in the thickness direction. The uneven distribution means that the distribution of germanium atoms and/or tin atoms in the photosensitive layer is uniform in the direction parallel with the surface of the support but is uneven in the thickness direction.)

And in the photosensitive layer of the light receiving member according to this invention, it is desirable that germanium atoms and/or tin atoms in the photosensitive layer be present in the side region adjacent to the support in a relatively large amount in uniform distribution state or be present more in the support side region than in the free surface side region. In these cases, when the distributingconcentration of germanium atoms and/or tin atoms are extremely heightened in the side region adjacent to the support, the light of long wavelength, which can be hardly absorbed in the constituent layer or the layer region near the free surface side of the light receiving layer when a light of long wavelength such as a semiconductor emitting ray is used as the light source, can be substantially and completely absorbed in the constituent layer or in the layer region respectively adjacent to the support for the light receiving layer. And this is directed to prevent the interference caused by the light reflected from the surface of the support.

As above explained, in the photosensitive layer of the light receiving member according to this invention, germanium atoms and/or tin atoms may be distributed either uniformly in the entire layer region or the partial constituent layer region or unevenly and continuously in the direction of the layer thickness in the entire layer region or the partial constituent layer region.

In the following an explanation is made of the typical examples of the continuous and uneven distribution of germanium atoms in the thickness direction in the photosensitive layer, with reference to FIGS. 7 through 15.

In FIGS. 7 through 15, the abscissa represents the distribution concentration C of germanium atoms and the ordinate represents the thickness of the entire photosensitive layer or the partial constituent layer adjacent to the support; and $t_B$ represents the extreme position of the photosensitive layer adjacent to the support, and $t_T$ represent the other extreme position adjacent to the surface layer which is away from the support, or the position of the interface between the constituent layer containing germanium atoms and the constituent layer not containing germanium atoms.

That is, the photosensitive layer containing germanium atoms is formed from the $t_B$ side toward $t_T$ side.

In these figures, the thickness and concentration are schematically exaggerated to help understanding.

Figure 7:
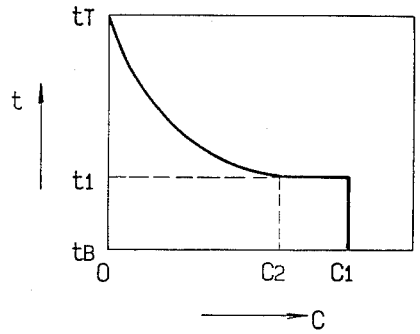
FIGS. 7 through 15 are views illustrating the thicknesswise distribution of germaniums atoms or tin atoms in the photosensitive layer of the light receiving member according to this invention.

FIG. 7 shows the first typical example of the thicknesswise distribution of germanium atoms in the photosensitive layer.

In the example shown in FIG. 7, germanium atoms are distributed such that the concentration C is constant at a value $C_1$ in the range from position $t_B$ (at which the photosensitive layer containing germanium atoms is in contact with the surface of the support) to position $t_1$, and the concentration C gradually and continuously decreases from $C_2$ in the range from position $t_1$ to position $t_T$ at the interface. The concentration of germanium atoms is substantially zero at the interface position $t_T$.

("Substantially zero" means that the concentration is lower than the detectable limit.)

Figure 8:
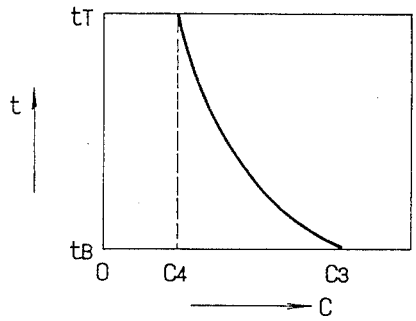

In the example shown in FIG. 8, the distribution of germanium atoms contained in such that concentration $C_3$ at position $t_B$ gradually and continuously decreases to concentration $C_4$ at position $t_T$.

Figure 9:
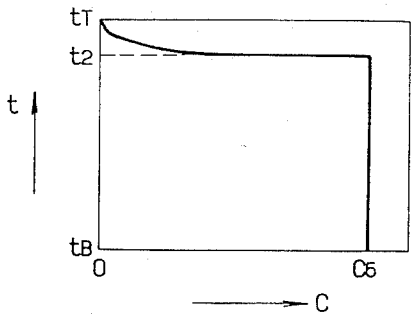

In the example shown in FIG. 9, the distribution of germanium atoms is such that concentration $C_5$ is constant in the range from position $t_B$ and position $t_2$ and it gradually and continuously decreases in the range from position $t_2$ and position $t_T$. The concentration at position $t_T$ is substantially zero.

Figure 10:
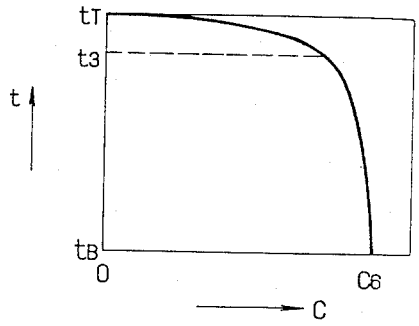

In the example shown in FIG. 10, the distribution of germanium atoms is such that concentration $C_6$ gradually and continuously decreases in the range from position $t_B$ and position $t_3$, and it sharply and continuously decreases in the range from position $t_3$ to position $t_T$. The concentration at position $t_T$ is substantially zero.

Figure 11:
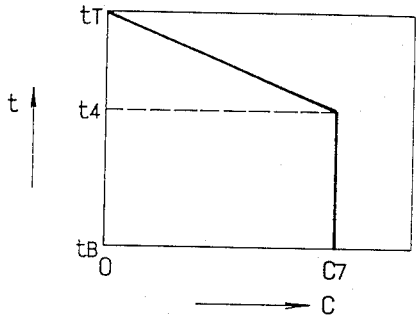

In the example shown in FIG. 11, the distribution of germanium atoms C is such that concentration $C_7$ is constant in the range from position $t_B$ and position $t_4$ and it linearly decreases in the range from position $t_4$ to position $t_T$. The concentration at position $t_T$ is zero.

Figure 12:
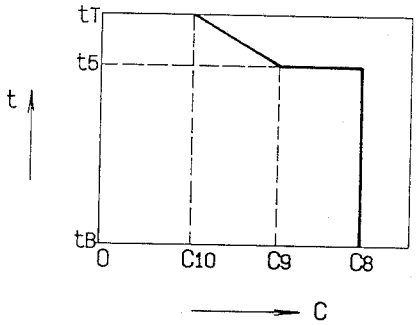

In the example shown in FIG. 12, the distribution of germanium atoms is such that concentration $C_8$ is constant in the range from position $t_B$ and position $t_5$ and concentration $C_9$ linearly decreases to concentration $C_{10}$ in range from position $t_5$ to position $t_T$.

Figure 13:
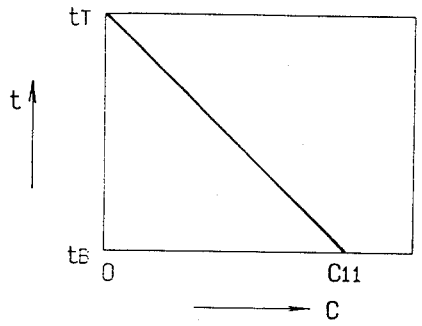

In the example shown in FIG. 13, the distribution of germainum atoms is uuch that concentration linearly decreases to zero in the range from position $t_B$ to position $t_T$.

Figure 14:
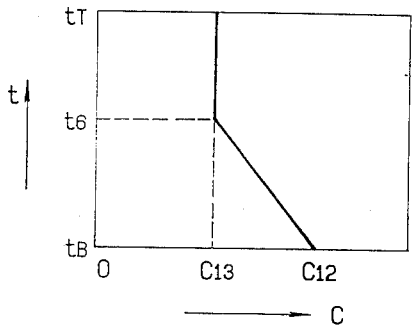

In the example shown in FIG. 14, the distribution of germanium atoms is such that concentration $C_{12}$ linearly decreases to $C_{13}$ in the range from position $t_B$ to position $t_6$ and concentration $C_{13}$ remains constant in the range from position $t_6$ to position $t_T$.

Figure 15:
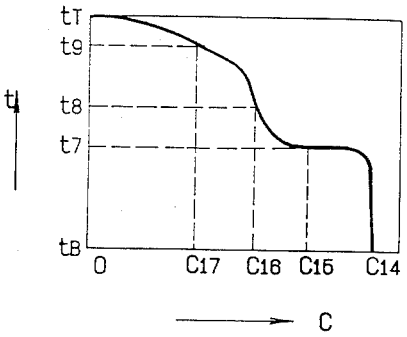

In the example shown in FIG. 15, the distribution of germanium atoms is such that concentration $C_{14}$ at position $t_B$ slowly decreases and then sharply decreases to concentration $C_{15}$ in the range from position $t_B$ to position $t_7$.

In the range from position $t_7$ to position $t_8$, the concentration sharply decreases at first and slowly decreases to $C_{16}$ at position $t_8$. The concentration slowly decreases to $C_{17}$ between poistion $t_8$ and position $t_9$. Concentration $C_{17}$ further decreases to substantially zero between position $t_9$ and position $t_T$. The concentration decreases as shown by the curve.

Several examples of the thicknesswise distribtuion of germanium atoms and/or tin atoms in the layer 102' have been illustrated in FIGS. 7 through 15. In the light receiving member of this invention, the concentration of germanium atoms and/or tin atoms in the photosensitive layer should preferably be high at the position adjacent to the support and considerably low at the position adjacent to the interface $t_T$.

In other words, it is desirable that the photosensitive layer constituting the light receiving member of this invention have a region adjacent to the support in which germanium atoms and/or tin atoms are locally contained at a comparatively high concentration.

Such a local region in the light receiving member of this invention should preferably be formed within 5 μm from the interface $t_B$.

The local region may occupy entirely or partly the thickness of 5 μm from the interface position $t_B$.

Whether the local region should occupy entirely or partly the layer depends on the performance required for the light receiving layer to be formed.

The thicknesswise distribution of germanium atoms and/or tin atoms contained in the local region should be such that the maximum concentration $C_{max}$ of germanium atoms and/or tin atoms is greater than 1000 atomic ppm, preferably greater than 5000 atomic ppm, and more preferably greater than $1\times10^4$ atomic ppm based on the amount of silicon atoms.

In other words, in the light receiving member of this invention, the photosensitive layer which contains germanium atoms and/or tin atoms should preferably be formed such that the maximum concentration $C_{max}$ of their distribution exists within 5 μm of thickness from $t_B$ (or from the support side).

In ther light receiving member of this invention, the amount of germanium atoms and/or tin atoms in the photosensitive layer should be properly determined so that the object of the invention is effectively achieved. It is usually 1 to $6\times10^5$ atomic ppm, preferably 10 to $3\times10^5$ atomic ppm, and more preferably $1\times10^2$ to $2\times10^5$ atomic ppm.

The photosensitive layer of the light receiving member of this invention may be incorporated with at least one kind selected from oxygen atoms, carbon atoms, nitrogen atoms. This is effective in increasing the photosensitivity and dark resistance of the light receiving member and also in improving adhesion between the support and the light receiving layer.

In the case of incorporating at least one kind selected from oxygen atoms, carbon atoms, and nitrogen atoms into the photosensitive layer of the light receiving member according to this invention, it is performed at a uniform distribution or uneven distribution in the direction of the layer thickness depending on the purpose or the expected effects as described above, and accordingly, the content is varied depending on them.

That is, in the case of increasing the photosensitivity, the dark resistance of the light receiving member, they are contained at a uniform distribution over the entire layer region of the photosensitive layer. In this case, the amount of at least one kind selected from carbon atoms, oxygen atoms, and nitrogen atoms contained in the photosensitive layer may be relatively small.

In the case of improving the adhesion between the support and the photosensitive layer, at least one kind selected from carbon atoms, oxygen atoms, and nitrogen atoms is contained uniformly in the layer constituting the photosensitive layer adjacent to the support, or at least one kind selected from carbon atoms, oxygen atoms, and nitrogen atoms is contained such that the distribution concentration is higher at the end of the photosensitive layer on the side of the support. In this case, the amount of at least one kind selected from oxygen atoms, carbon atoms, and nitrogen atoms is comparatively large in order to improve the adhesion to the support.

The amount of at least one kind selected from oxygen atoms, carbon atoms, and nitrogen atoms contained in the photosensitive layer of the light receiving member according to this invention is also determined while considering the organic relationship such as the performance at the interface in contact with the support, in addition to the preformance required for the light receiving layer as described above and it is usually from 0.001 to 50 atomic %, preferably, from 0.002 to 40 atomic %, and, most suitably, from 0.003 to 30 atomic %.

By the way, in the case of incorporating the element in the entire layer region of the photosensitive layer or the proportion of the layer thickness of the layer region incorporated with the element is greater in the layer thickness of the light receiving layer, the upper limit for the content is made smaller. That is, if the thickness of the layer region incorporated with the element is 2/5 of the thickness for the photosensitive layer, the content is usually less than 30 atomic %, preferably, less than 20 atomic % and, more suitably, less than 10 atomic %.

Some typical examples in which a relatively large amount of at least one kind selected from oxygen atoms, carbon atoms, and nitrogen atoms is contained in the photosensitive layer according to this invention on the side of the support, then the amount is gradually decreased from the end on the side of the support to the end on the side of the free surface and decreased further to a relatively small amount or substantially zero near the end of the photosensitive layer on the side of the free surface will be hereunder explained with reference to FIGS. 16 through 24. However, the scope of this invention is not limited to them.

The content of at least one of the elements selected from oxygen atoms(O), carbon atoms(C) and nitrogen atoms(N) is hereinafter referred to as "atoms(O,C,N)".

In FIGS. 16 through 24, the abscissa represents the distribution concentration C of the atoms(O,C,N) and the ordinate represents the thickness of the photosensitive layer; and $t_B$ represents the interface position between the support and the photosensitive layer and $t_T$ represents the interface position between the free surface and the photosensitive layer.

Figure 16:
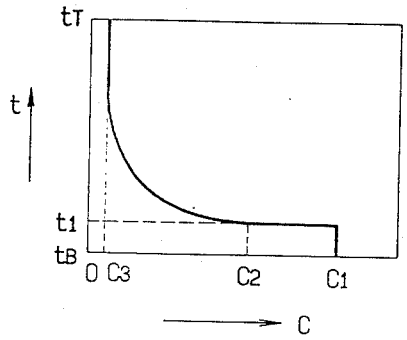
FIGS. 16 through 24 are views illustrating the thicknesswise distribution of oxygen atom, carbon atoms, or nitrogen atoms, or the thicknesswise distribution of the group III atoms or the group V atoms in the photosensitive layer of the light receiving member according to this invention, the ordinate representing the thickness of the photsensitive layer and the abscissa representing the distribution concentration of respective atoms.

FIG. 16 shows the first typical example of the thicknesswise distribution of the atoms(O,C,N) in the photosensitive layer. In this example, the atoms(O,C,N) are distributed in the way that the concentration C remains constant at a value $C_1$ in the range from position $t_B$ (at which the photosensitive layer comes into contact with the support) to position $t_1$, and the concentration C gradually and continuously decreases from $C_2$ in the range from position $t_1$ to position $t_T$, where the concentration of the group III atoms or group V atoms is $C_3$.

Figure 17:
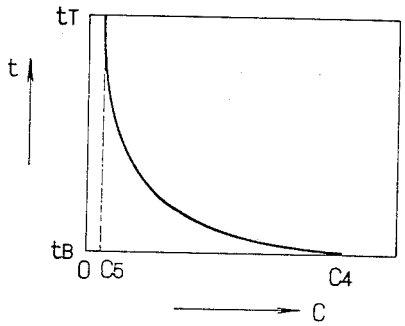

In the example shown in FIG. 17, the distribution concentration C of the atoms(O,C,N) contained in the photosensitive layer is such that concentration $C_4$ at position $t_B$ continuously decreases to concentration $C_5$ at position $t_T$.

Figure 18:
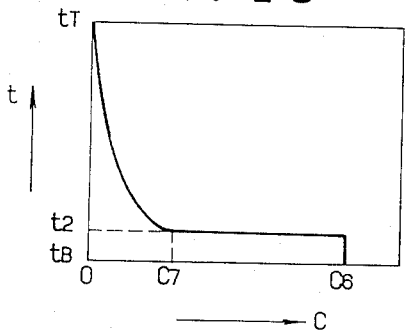

In the example shown in FIG. 18, the distribution concentration C of the atoms(O,C,N) is such that concentration $C_6$ remains constant in the range from position $t_B$ and position $t_2$ and it gradually and continuously decreases in the range from position $t_2$ and position $t_T$. The concentration at position $t_T$ is substantially zero.

Figure 19:
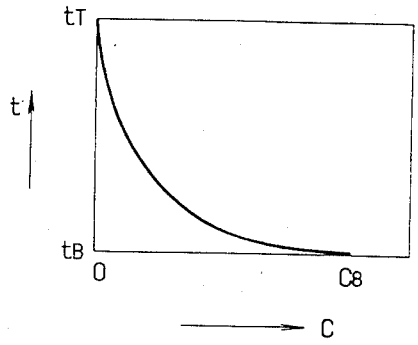

In the example shown in FIG. 19, the distribution concentration C of the atoms(O,C,N) is such that concentration $C_8$ gradually and continuously decreases in the range from position $t_B$ and position $t_T$, at which it is substantially zero.

Figure 20:
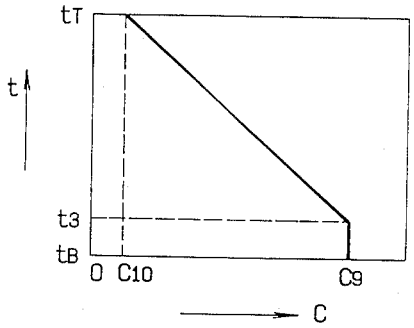

In the example shown in FIG. 20, the distributoon concentration C of the atoms(O,C,N) is such that concentration $C_9$ remains constant in the range from position $t_B$ to position $t_3$, and concentration $C_8$ linearly decreases to concentration $C_{10}$ in the range from position $t_3$ to position $t_T$.

Figure 21:
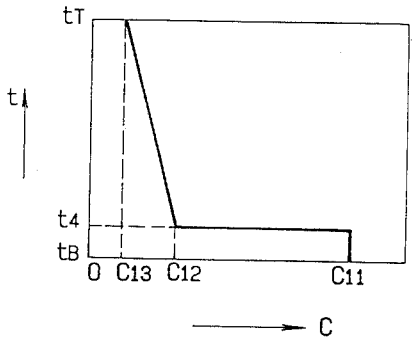

In the example shown in FIG. 21, the distribution concentration C of the atoms(O,C,N) is such that concentration $C_{11}$ remains constant in the range from position $t_B$ and position $t_4$ and it linearly decreases to $C_{14}$ in the range from position $t_4$ to position $t_T$.

Figure 22:
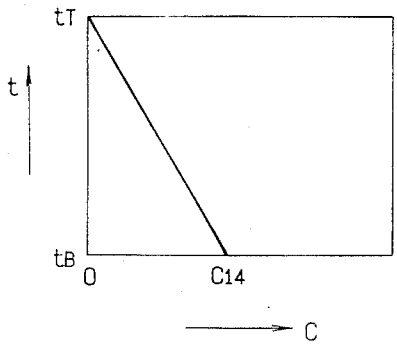

In the example shown in FIG. 22, the distribution concentration C of the atoms(O,C,N) is such that concentration $C_{14}$ linearly decreases in the range from position $t_B$ to position $t_T$, at which the concentration is substantially zero.

Figure 23:
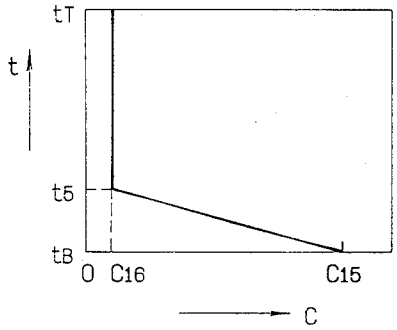

In the example shown in FIG. 23, the distribution concentration C of the atoms(O,C,N) is such that concentration $C_{15}$ linearly decreases to concentration $C_{16}$ in the range from position $t_B$ to position $t_5$ and concentration $C_{16}$ remains constant in the range from position $t_5$ to position $t_T$.

Figure 24:
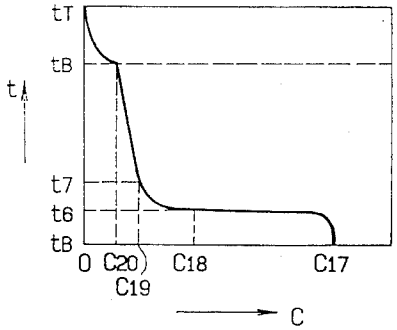

Finally, in the example shown in FIG. 24, the distribution concentration C of the atoms(O,C,N) is such that concentration $C_{17}$ at position $t_B$ slowly decreases and then sharply decreases to concentration $C_{18}$ in the range from position $t_B$ to position $t_6$. In the range from position $t_6$ to position $t_7$, the concentration sharply decreases at first and slowly decreases to $C_{19}$ at position $t_7$. The concentration slowly decreases between position $t_7$ and position $t_8$, at which the concentration is $C_{20}$. Concentration $C_{20}$ slowly decreases to substantially zero between position $t_8$ and position $t_T$.

As shown in the embodiments of FIGS. 16 through 24, in the case where the distribution concentration C of the atoms(O,C,N) is higher at the portion of the photosensitive layer near the side of the support, while the distribution concentration C is considerably lower or substantially reduced to zero in the portion of the photosensitive layer in the vicinity of the free surface, the improvement in the adhesion of the photosensitive layer with the support can be more effectively attained by disposing a localized region where the distribution concentration of the atoms(O,C,N) is relatively higher at the portion near the side of the support, preferably, by disposing the localized region at a position within 5 μm from the interface position adjacent to the support surface.

The localized region may be disposed partially or entirely at the end of the light receiving layer to be contained with the atoms(O,C,N) on the side of the support, which may be properly determined in accordance with the performance required for the light receiving layer to be formed.

It is desired that the amount of the atoms(O,C,N) contained in the localized region is such that the maximum value of the distribution concentration C of the atoms(O,C,N) is greater than 500 atomic ppm, preferably, greater than 800 atomic ppm, most preferably greater than 1000 atomic ppm in the distribution.

In the photosensitive layer of the light receiving member according to this invention, a substance for controlling the electroconductivity may be contained to the photosensitive layer in a uniformly or unevenly distributed state to the entire or partial layer region.

As the substance for controlling the conductivity, so-called impurities in the field of the semiconductor can be mentioned and those usable herein can include atoms belonging to the group III of the periodic table that provide p-type conductivity (hereinafter simply referred to as "group III atoms") or atoms belonging to the group V of the periodic table that provide n-type conductivity (hereinafter simply referred to as "group V atoms"). Specifically, the group III atoms can include B (boron),AAl (aluminum), Ga (gallium), In (indium), and Tl (thallium), B and Ga being particularly preferred. The group V atoms can include, for example, P (phosphorus), As (arsenic), Sb (antimony), and Bi (bismuth), P and Sb being particularly preferred.

In the case of incorporating the group III or group V atoms as the substance for controlling the conductivity into the photosensitive layer of the light receiving member according to this invention, they are contained in the entire layer region or partial layer region depending on the purpose or the expected effects as described below and the content is also varied.

That is, if the main purpose resides in the control for the conduction type and/or conductivity of the photosensitive layer, the substance is contained in the entire layer region of the photosensitive layer, in which the content of group III or group V atoms may be relatively small and it is usually from $1\times10^{-3}$ to $1\times10^{3}$ atomic ppm, preferably from $5\times10^{-2}$ to $5\times10^{2}$ atomic ppm, and most suitably, from $1\times10^{-1}$ to $5\times10^{2}$ atomic ppm.

In the case of incorporating the group III or group V atoms in a uniformly distributed state to a portion of the layer region in contact with the support, or the atoms are contained such that the distribution density of the group III or group V atoms in the direction of the layer thickness is higher on the side adjacent to the support, the constituting layer containing such group III or group V atoms or the layer region containing the group III or group V atoms at high concentration function as a charge injection inhibition layer. That is, in the case of incorporating the group III atoms, movement of electrons injected from the side of the support into the photosensitive layer can effectively be inhibited upon applying the charging treatment of at positive polarity at the free surface of the photosensitive layer. While on the other hand, in the case of incorporating the group III atoms, movement of positive holes injected from the side of the support into the photosensitive layer can effectively be inhibited upon applying the charging treatment at negative polarity at the free surface of the layer. The content in this case is relatively great. Specifically, it is generally from 30 to $5\times10^{4}$ atomic ppm, preferably from 50 to $1\times10^{4}$ atomic ppm, and most suitably from $1\times10^{2}$ to $5\times10^{3}$ atomic ppm. Then, for the charge injection inhibition layer to produce the intended effect, the thickness (T) of the photo-sensitive layer and the thickness (t) of the layer or layer region containing the group III or group V atoms adjacent to the support should be determined such that the relation $t/T\leqq0.4$ is established. More preferably, the value for the relationship is less than 0.35 and, most suitably, less than 0.3. Further, the thickness (t) of the layer or layer region is generally $3\times10^{-3}$ to 10 $\mu$m, preferably $4\times10^{3}$ to 8 $\mu$m, and, most suitably, $5\times10^{-3}$ to 5 $\mu$m.

Further, typical embodiments in which the group III or group V atoms incorporated into the light receiving layer is so distributed that the amount therefore is relatively great on the side of the support, decreased from the support toward the free surface of the light receiving layer, and is relatively smaller or substantially equal to zero near the end on the side of the free surface, may be explained on the analogy of the examples in which the photosensitive layer contains the atoms(O,C,N) as shown in FIGS. 16 to 24. However, this invention is no way limited only to these embodiments.

As shown in the embodiments of FIGS. 16 through 24, in the case where the distribution density C of the group III or group V atoms is higher at the portion of the photosensitive layer near the side of the support, while the distribution density C is considerably lower or substantially reduced to zero in the interface between the photosensitive layer and the surface layer, the foregoing effect that the layer region where the group III or group V atoms are distributed at a higher density can form the charge injection inhibition layer as described above more effectively, by disposing a localized region where the distribution density of the group III or group V atoms is relatively higher at the portion near the side of the support, preferably, by disposing the localized region at a position within 5$\mu$ from the interface position in adjacent with the support surface.

While the individual effects have been described above for the distribution state of the group III or group V atoms, the distribution state of the group III or group V atoms and the amount of the group III or group V atoms are, of course, combined properly as required for obtaining the light receiving member having performances capable of attaining a desired purpose. For instance, in the case of disposing the charge injection inhibition layer at the end of the photosensitive layer on the side of the support, a substance for controlling the conductivity of a polarity different from that of the substance for controlling the conductivity contained in the charge injection inhibition layer may be contained in the photosensitive layer other than the charge injection inhibition layer, or a substance for controlling the conductivity of the same polarity may be contained by an amount substantially smaller than that contained in the charge inhibition layer.

Further, in the light receiving member according to this invention, a so-called barrier layer composed of electrically insulating material may be disposed instead of the charge injection inhibition layer as the constituent layer disposed at the end on the side of th support, or both of the barrier layer and the charge injection inhibition layer may be disposed as the constituent layer. The material for constituting the barrier layer can include, for example, those inorganic electrically insulating materials such as $Al_2O_3$, $SiO_2$ and $Si_3N_4$ or organic electrically insulating material such as polycarbonate.

Surface Layer

The surface layer 103 of the light receiving member of this invention is disposed on the photosensitive layer 102 and has the free surface 104.

To dispose the surface layer 103 on the photosensitive layer in the light receiving member according to this invention is aimed at reducing the reflection of an incident-light and increasing the transmission rate at the free surface 104 of the light receiving member, and improving various properties such as the moisture-proofness, the property for continuous repeating use, electrical voltage withstanding property, circumstantial resistance and durability of the light receiving member.

As the material for forming the surface layer, it is required to satisfy various conditions in that it can provide the excellent reflection preventive function for the layer constitued therewith, and a function of improving the various properties as described above, as well as those conditions in that it does not give undesired effects on the photoconductivity of the light receiving member, provides an adequate electronic photographic property, for example, an electric resistance over a certain level, provide an excellent solvent resistance in the case of using the liquid developing process and it does not reduce the various properties of the light receiving layer already formed. Those materials that can satisfy such various conditions and can be used effectively include the following two types of materials.

One of them is an amorphous material which contains silicon atoms(Si), at least one kind selected from oxygen atoms(O), carbon atoms(C) and nitrogen atoms(N), and preferably in addition to these, either hydrogen atoms(H) or halogen atoms(X). [hereinafter referred to as "a-Si(O,C,N)(H,X)"]

The other one is at least one material selected from the group consisting of inorganic fluorides, inorganic oxides, and inorganic sulfides such as $MgF_2$, $Al_2O_3$, $ZrO_2$, $TiO_2$, ZnS, $CeO_2$, $CeF_3$, $Ta_2O_5$, $AlF_3$, and NaF.

And, in the light receiving member according to this invention, the surface layer 103 is constituted as a multi-layered structure at least comprising an abrasion-resistant layer at the outermost side and the reflection preventive layer at the inside in order to overcome the problems of the interference fringe or uneven sensitivity resulted from the uneven thickness of the surface layer. That is, in the light receiving member comprising the surface layer of the multi-layered structure, since a plurality of interfaces are resulted in the surface layer and the reflections at the respective interfaces are offset with each other and, accordingly, the reflection at the interface between the surface layer and the light sensitive layer can be decreased, the problem in the prior art that the reflection rate is changed due to the uneven thickness of the surface layer can be overcome.

It is of course possible to constitute the abrasion resistant layer (outermost layer) and the reflection preventive layer (inner layer) for constituting the surface layer as a single layer structure or two or more multi-layered structure provided that the properties required for them can be satisfied.

For constituting the surface layer as such a multi-layered structure, the optical band gaps (Eopt) of the layer constituting the abrasion-resistant layer (outermost layer) and the reflection preventive layer (inner layer) are made different. Specifically, it is adapted such that the refractive index of the abrasion-resistant layer (outermost layer), the refractive index of the reflection preventive layer (inner layer) and the refractive index of the light sensitive layer to which the surface layer is disposed directly are made different from each other.

Then, the reflection at the interface between the light sensitive layer and the surface layer can be reduced to zero by satisfying the relationship represented by the following equation:

$$n_3 = \sqrt{n_1, n_2} \text{ (where } n_1 < n_3 < n_2)$$

$$2n_3d = (\tfrac{1}{2} + m)\lambda \text{ (} m \text{ represents an integer)}$$

wherein $n_1$ is the refractive index of the photosensitive layer, $n_2$ is a refractive index of the abrasion-resistant layer constituting the surface layer, $n_3$ is a refractive index of the reflection preventive layer, d is a thickness of the reflection preventive layer and $\lambda$ is the wavelength of the incident light.

Although the relationship is defined as: $n_1<n_3<n_2$ in the embodiment described above, the relation is not always limited only thereto but it may, for example, be defined as $n_1<n_2<n_3$.

For instance, in the case of constituting the surface layer with an amorphous material containing silicon atoms, and at least one of the elements selected from oxygen atoms, carbon atoms or nitrogen atoms, the refractive indexes are made different by making the amount of oxygen atoms, carbon atoms or hydrogen atoms contained in the surface layer different between the abrasion-resistant layer and the reflection preventive layer. Specifically, in the case of constituting the photosensitive layer with a-SiH and the surface layer with a-SiCH, the amount of the carbon atoms contained in the abrasion-resistant layer is made greater than the amount of the carbon atoms contained in the reflection preventive layer and the refractive index $n_1$ of the light sensitive layer, the refractive index $n_3$ of the reflection preventive layer, the refractive index $n_2$ of the abrasion-resistant layer and the thickness d of the abrasion-resistant layer are made as: $n_1 \approx 2.0$, $n_2 \approx 3.5$, $n_3 \approx 2.65$ and $d \approx 755$ Å respectively. Further, by making the amount of the oxygen atoms, carbon atoms or nitrogen atoms contained in the surface layer different between the abrasion-resistant layer and the reflection preventive layer, the refractive indexes in each of the layers can be made different. Specifically, the abrasion-resistant layer can be formed with a-SiC(H,X) and the reflection preventive layer can be formed with a-SiN(H,X) or a-SiO(H,X).

At least one of the elements selected from the oxygen atoms, carbon atoms and nitrogen atoms is contained in a uniformly distributed state in the abrasion-resistant layer and the reflection preventive layer constituting the surface layer. The foregoing various properties can be improved along with the increase in the amount of these atoms contained. However, if the amount is excessive, the layer quality is lowered and the electrical and mechanical properties are also degraded. In view of the above, the amount of these atoms contained in the surface layer is defined as usually from 0.001 to 90 atm %, preferably, from 1 to 90 atm % and, most suitably, from 10 to 80 atm %. Further, it is desirable that at least one of the hydrogen atoms and halogen atoms is contained in the surface layer, in which the amount of the hydrogen atoms(H), the amount of the halogen atoms(X) or the sum of the amounts of the hydrogen atoms and the halogen atoms (H+X) contained in the surface layer is usually from 1 to 40 atm %, preferably, from 5 to 30 atm % and, most suitably, from 5 to 25 atm %.

Furthermore, in the case of constituting the surface layer with at least one of the compounds selected from the inorganic fluorides, inorganic oxides and inorganic sulfides, they are selectively used such that the refractive indexes in each of the light sensitive layer, the abrasion-resistant layer and the reflection preventive layer are different and the foregoing conditions can be satisfied while considering the refractive indexes for each of the inorganic compound exempliefied above and the mixture thereof. Numerical values in the parentheses represent the refractive indexes of the inorganic compounds and the mixtures thereof. $ZrO_2$ (2.00), $TiO_2$ (2.26), $ZrO_2/TiO_2=6/1$ (2.09), $TiO_2/ZrO_2=3/1$ (2.20), $GeO_2$ (2.23), ZnS (2.24), $Al_2O_3$ (1.63), $GeF_3$ (1.60), $Al_2O_3/ZrO_2=1/1$ (1.68), $MgF_2$ (1.38). These refractive indexes may of course vary somewhat depending on the kind of the layer prepared and the preparing conditions.

Furthermore, the thickness of the surface layer is one of the important factors for effectively attaining the purpose of this invention and the thickness is properly determined depending on the desired purposes. It is required that the thickness be determined while considering the relative and organic relationships depending on the amount of the oxygen atoms, carbon atoms, nitrogen atoms, halogen atoms and hydrogen atoms contained in the layer or the properties required for the surface layer. Further, the thickness has to be determined also from economical point of view such as the productivity and the mass productivity. In view of the above, the thickness of the surface layer is usually from $3\times10^{-3}$ to 30μ, more preferably, from $4\times10^{-3}$ to 20μ and, most preferably, $5\times10^{-3}$ to 10μ.

By adopting the layer structure of the light receiving member according to this invention as described above, all of the various problems in the light receiving members comprising the light receiving layer constituted with amorphous silicon as described above can be overcome. Particularly, in the case of using the coherent laser beams as a light source, it is possible to remarkably prevent the occurrence of the interference fringe pattern upon forming images due to the interference phenomenon thereby enabling to obtain reproduced image at high quality.

Further, since the light receiving member according to this invention has a high photosensitivity in the entire visible ray region and, further, since it is excellent in the photosensitive property on the side of the longer wavelength, it is suitable for the matching property, particularly, with a semiconductor laser, exhibits a rapid optical response and shows more excellent electrical, optical and electroconductive nature, electrical voltage withstand property and resistance to working circumstances.

Particularly, in the case of applying the light receiving member to the electrophotography, it gives no undesired effects at all of the residual potential to the image formation, stable electrical properties high sensitivity and high S/N ratio, excellent light fastness and property for repeating use, high image density and clear half tone and can provide high quality image with high resolution power repeatingly.

The method of forming the light receiving layer according to this invention will now be explained.

The amorphous material constituting the light receiving layer in this invention is prepared by vacuum deposition technique utilizing the discharging phenomena such as glow discharging, sputtering, and ion plating process. These production processes are properly used selectively depending on the factors such as the manufacturing conditions, the installation cost required, production scale and properties required for the light receiving members to be prepared. The glow discharging process or sputtering process is suitable since the control for the condition upon preparing the light receiving members having desired properties are relatively easy and carbon atoms and hydrogen atoms can be introduced easily together with silicon atoms. The glow discharging process and the sputtering process may be used together in one identical system.

Basically, when a layer constituted with a-Si(H,X) is formed, for example, by the glow discharging process, gaseous starting material for supplying Si capable of supplying silicon atoms(Si) are introduced together with gaseous starting material for introducing hydrogen atoms(H) and/or halogen atoms(X) into a deposition chamber the inside pressure of which can be reduced, glow discharge is geenrated in the deposition chamber, and a layer composed of a-Si(H,X) is formed on the surface of a predetermined support disposed previously at a predetermined position in the chamber.

The gaseous starting material for supplying Si can include gaseous or gasifiable silicon hydrides (silanes) such as $SiH_4$, $Si_2H_6$, $Si_3H_8$, $Si_4H_{10}$, etc., $SiH_4$ and $Si_2H_6$ being particularly preferred in view of the easy layer forming work and the good efficiency for the supply of Si.

Further, various halogen compounds can be mentioned as the gaseous starting material for introducing the halogen atoms and gaseous or gasifiable halogen compounds, for example, gaseous halogen, halides, inter-halogen compounds and halogen-substituted silane derivatives are preferred. Specifically, they can include halogen gas such as of fluorine, chlorine bromine, and iodine; inter-halogen compounds such as BrF, ClF, $ClF_3$, $BrF_2$, $BrF_3$, $IF_7$, ICl, IBr, etc.; and silicon halides such as $SiF_4$, $Si_2H_6$, $SiCl_4$, and $SiBr_4$. The use of the gaseous or gasifiable silicon halide as described above is particularly advantagous since the layer constituted with halogen atom-containing a-Si can be formed with no additional use of the gaseous starting material for supplying Si.

The gaseous starting material usable for supplying hydrogen atoms can include those gaseous or gasifiable materials, for example, hydrogen gas, halides such as HF, HCl, HBr, and HI, silicon hydrides such as $SiH_4$, $Si_2H_6$, $Si_3H_8$, and $Si_4O_{10}$, or halogen-substituted silicon hydrides such as $SiH_2F_2$, $SiH_2I_2$, $SiH_2Cl_2$, $SiHCl_3$, $SiH_2Br_2$, and $SiHBr_3$. The use of these gaseous starting material is advantageous since the content of the hydrogen atoms(H), which are extremely effective in view of the control for the electrical or photoelectronic properties, can be controlled with ease. Then, the use of the hydrogen halide or the halogen-substituted silicon hydride as described above is particularly advantageous since the hydrogen atoms(H) are also introduced together with the introduction of the halogen atoms.

In the case of forming a layer comprising a-Si(H,X) by means of the reactive sputtering process or ion plating process, for example, by the sputtering process, the halogen atoms are introduced by introducing gaseous halogen compounds or halogen atom-containing silicon compounds into a deposition chamber thereby forming a plasma atmosphere with the gas.

Further, in the case of introducing the hydrogen atoms, the gaseous starting material for introducing the hydrogen atoms, for example, $H_2$ or gaseous silanes are described above are introduced into the sputtering deposition chamber thereby forming a plasma atxosphere with the gas.

For instance, in the case of the reactive sputtering process, a layer comprising a-Si(H,X) is formed on the support by using a Si target and by introducing a halogen atom-introducing gas and $H_2$ gas together with an inert gas such as He or Ar as required into a deposition chamber thereby forming a plasma atxosphere and then sputtering the Si target.

To form the layer of a-SiGe(H,X) by the glow discharge process, a feed gas to liberate silicon atoms(Si), a feed gas to liberate germanium atoms(Ge), and a feed gas to liberate hydrogen atoms(H) and/or halogen atoms(X) are introduced under appropriate gaseous pressure condition into an evacuatable deposition chamber, in which the glow discharge is generated so that a layer of a-SiGe(H,X) is formed on the properly positioned support in the chamber.

The feed gases to supply silicon atoms, halogen atoms, and hydrogen atoms are the same as those used to form the layer of a-Si(H,X) mentioned above.

The feed gas to liberate Ge includes gaseous or gasifiable germanium halides such as $GeH_4$, $Ge_2H_6$, $Ge_3H_8$, $Ge_4H_{10}$, $Ge_5H_{12}$, $Ge_6H_{14}$, $Ge_7H_{16}$, $Ge_8H_{18}$, and $Ge_9H_{20}$, with $GeH_4$, $Ge_2H_6$ and $Ge_3H_8$, being preferable on account of their ease of handling and the effective liberation of germanium atoms.

To form the layer of a-SiGe(H,X) by the sputtering process, two targets (a silicon target and a germanium target) or a single target composed of silicon and germanium is subjected to sputtering in a desired gas atmosphere.

To form the layer of a-SiGe(H,X) by the ion-plating process, the vapors of silicon and germanium are allowed to pass through a desired gas plasma atmosphere. The silicon vapor is produced by heating polycrystal silicon or single crystal silicon held in a boat, and the germanium vapor is produced by heating polycrystal germanium or single crystal germanium held in a boat. The heating is accomplished by resistance heating or electron beam method (E.B. method).

In either case where the sputtering process or the ion plating process is employed, the layer may be incorporated with halogen atoms by introducing one of the above-mentioned gaseous halides or halogen-containing silicon compounds into the deposition chamber in which a plasma atmosphere of the gas is produced. In the case where the layer is incorporated with hydrogen atoms, a feed gas to liberate hydrogen is introduced into the deposition chamber in which a plasma atmosphere of the gas is produced. The feed gas may be gaseous hydrogen, silanes, and/or germanium hydride. The feed gas to liberate halogen atoms includes the above-mentioned halogen-containing silicon compounds. Other examples of the feed gas include hydrogen halides such as HF, HCl, HBr, and HI; halogen-substituted silanes such as $SiH_2F_2$, $SiH_2I_2$, $SiH_2Cl_2$, $SiHCl_3$, $SiH_2Br_2$, and $SiHBr_3$; germanium hydride halide such as $GeHF_3$, $GeH_2F_2$, $GeH_3F$, $GeHCl_3$, $GeH_2Cl_2$, $GeH_3Cl$, $GeHBr_3$, $GeH_2Br_2$, $GeH_3Br$, $GeHI_3$, $GeH_2I_2$, and $GeH_3I$; and germanium halides such as $GeF_4$, $GeCl_4$, $GeBr_4$, $GeI_4$, $GeF_2$, $GeCl_2$, $GeBr_2$, and $GeI_2$. They are in the gaseous form or gasifiable substances.

To form the light receiving layer composed of amorphous silicon containing tin atoms (referred to as a-SiSn(H,X) hereinafter) by the glow-discharge process, sputtering process, or ion-plating process, a starting material (feed gas) to release tin atoms(Sn) is used in place of the starting material to release germanium atoms which is used to form the layer composed of a-SiGe(H,X) as mentioned above. The process is properly controlled so that the layer contains a desired amount of tin atoms.

Examples of the feed gas to release tin atoms(Sn) include tin hydride ($SnH_4$) and tin halides (such as $SnF_2$, $SnF_4$, $SnCl_2$, $SnCl_4$, $SnBr_2$, $SnBr_4$, $SnI_2$, and $SnI_4$) which are in the gaseous form or gasifiable. Tin halides are preferable because they form on the substrate a layer of a-Si containing halogen atoms. Among tin halides, $SnCl_4$ is particularly preferable because of its ease of handling and its efficient tin supply.

In the case where solid $SnCl_4$ is used as a starting material to supply tin atoms(Sn), it should preferably be gasified by blowing (bubbling) an inert gas (e.g., Ar and He) into it while heating. The gas thus generated is introduced, at a desired pressure, into the evacuated deposition chamber.

The layer may be formed from an amorphous material [a-Si(H,X) or a-Si(Ge,Sn)(H,X)]which further contains the group III atoms or group V atoms, nitrogen atoms, oxygen atoms, or carbon atoms, by the glow-discharge process, sputtering process, or ion-plating process. In this case, the above-mentioned starting material for a-Si(H,X) or a-Si(Ge,Sn) (H,X) is used in combination with the starting materials to introduce the group III atoms or group V atoms, nitrogen atoms, oxygen atoms, or carbon atoms. The supply of the starting materials should be properly controlled so that the layer contains a desired amount of the necessary atoms.

If, for example, the layer is to be formed by the glow-discharge process from a-Si(H,X) containing atoms-(O,C,N) or from a-Si(Ge,Sn)(H,X) containing atoms-(O,C,N), the starting material to form the layer of a-Si(H,X) or a-Si(Ge,Sn)(H,X) should be combined with the starting material used to introduce atoms(O,C,N). The supply of these starting materials should be properly controlled so that the layer contains a desired amount of the necessary atoms.

The starting material to introduce the atoms(O,C,N) may be any gaseous substance or gasifiable substance composed of any of oxygen, carbon, and nitrogen. Examples of the starting materials used to introduce oxygen atoms(O) include oxygen ($O_2$), ozone ($O_3$), nitrogen dioxide ($NO_2$), nitrous oxide ($N_2O$), dinitrogen trioxide ($N_2O_3$), dinitrogen tetroxide ($N_2O_4$), dinitrogen pentoxide ($N_2O_5$), and nitrogen trioxide ($NO_3$). Additional examples include lower siloxanes such as disiloxane ($H_3SiOSiH_3$) and trisiloxane ($H_3SiOSiH_2OSiH_3$) which are composed of silicon atoms(Si), oxygen atoms(O), and hydrogen atoms(H), Examples of the starting materials used to introduce carbon atoms include saturated hydrocarbons having 1 to 5 carbon atoms such as methane ($CH_4$), ethane ($C_2H_6$), propane ($C_3H_8$), n-butane (n-$C_4H_{10}$), and pentane ($C_5H_{12}$); ethylenic hydrocarbons having 2 to 5 carbon atoms such as ethylene ($C_2H_4$), propylene ($C_3H_6$), butene-1 ($C_4H_8$), butene-2 ($C_4H_8$), isobutylene ($C_4H_8$), and pentene ($C_5H_{10}$); and acetylenic hydrocarbons having 2 to 4 carbon atoms such as acetylene ($C_2H_2$), methyl acetylene ($C_3H_4$), and butine ($C_4H_6$) Examples of the starting materials used to introduce nitrogen atoms include nitrogen ($N_2$), ammonia ($NH_3$), hydrazine ($H_2NNH_2$), hydrogen azide ($HN_3$), ammonium azide ($NH_4N_3$), nitrogen trifluoride ($F_3N$), and nitrogen tetrafluoride ($F_4N$).

For instance, in the case of forming a layer or layer region constituted with a-Si(H,X) or a-Si(Ge,Sn)(H,X) containing the group III atoms or group V atoms by using the glow discharging, sputtering, or ion-plating process, the starting material for introducing the group III or group V atoms are used together with the starting material for forming a-Si(H,X) or a-Si(Ge,Sn)(H,X) upon forming the layer constituted with a-Si(H,X) or a-Si(Ge,Sn)(H,X) as described above and they are incorporated while controlling the amount of them into the layer to be formed.

Referring specifically to the boron atoms introducing materials as the starting material for introducing the group III atoms, they can include boron hydrides such as $B_2H_6$, $B_4H_{10}$, $B_5H_9$, $B_5H_{11}$, $B_6H_{10}$, $B_6H_{12}$, and $B_6H_{14}$, and boron halides such as $BF_4$, $BCl_3$, and $BBr_3$. In addition, $AlCl_3$, $CaCl_3$, $Ga(CH_3)_2$, $InCl_3$, $TlCl_3$, and the like can also be mentioned.

Referring to the starting material for introducing the group V atoms and, specifically, to the phosphorus atom introducing materials, they can include, for example, phosphorus hydrides such as $PH_3$ and $P_2H_6$ and phosphorus halides such as $PH_4I$, $PF_3$, $PF_5$, $PCl_3$, $PCl_5$, $PBr_3$, $PBr_5$, and $PI_3$. In addition, $AsH_3$, $AsF_5$, $AsCl_3$, $AsBr_3$, $AsF_3$, $SbH_3$, $SbF_3$, $SbF_5$, $SbCl_3$, $SbCl_5$, $BiH_3$, $BiCl_3$, and $BiBr_3$ can also be mentioned to as the effective starting material for introducing the group V atoms.

In the case of using the glow discharging process for forming the layer or layer region containing oxygen atoms, starting material for introducing the oxygen atoms is added to those selected from the group of the starting material as described above for forming the light receiving layer. As the starting material for introducing the oxygen atoms, most of those gaseous or gasifiable materials can be used that comprse at least oxygen atoms as the constituent atoms.

For instance, it is possible to use a mixture of gaseous starting material comprising silicon atoms(Si) as the constituent atoms, gaseous starting material comprising oxygen atoms(O) as the constituent atoms and, as required, gaseous starting material comprising hydrogen atoms(H) and/or halogen atoms(X) as the constituent atoms in a desired mixing ratio, a mixture of gaseous starting material comprising silicon atoms(Si) as the constituent atoms and gaseous starting material comprising oxygen atoms(O) and hydrogen atoms(H) as the constituent atoms in a desired mixing ratio, or a mixture of gaseous starting material comprising silicon atoms(Si) as the constituent atoms and gaseous starting material comprising silicon atoms(Si), oxygen atoms(O) and hydrogen atoms(H) as the constituent atoms.

Further, it is also possible to use a mixture of gaseous starting material comprising silicon atoms(si) and hydrogen atoms(H) as the constituent atoms and gaseous starting material comprising oxygen atoms(O) as the constituent atoms.

Specifically, there can be mentioned, for example, oxygen ($O_2$), ozone ($O_3$), nitrogen monoxide (NO), nitrogen dioxide ($NO_2$), dinitrogen oxide ($N_2O$), dinitrogen trioxide ($N_2O_3$), dinitrogen tetroxide ($N_2O_4$), dinitrogen pentaxide ($N_2O_5$), nitrogen trioxide ($NO_3$), lower siloxanes comprising silicon atoms(Si), oxygen atoms(O) and hydrogen atoms(H) as the constituent atoms, for example, disiloxane ($H_3SiOSiH_3$) and trisiloxane ($H_3SiOSiH_2OSiH_3$), etc.

In the case of forming the layer or layer region containing oxygen atoms by way of the sputtering process, it may be carried out by sputtering a single crystal or polycrystalline Si wafer or $SiO_2$ wafer, or a wafer containing Si and $SiO_2$ in admixture is used as a target and sputtered in various gas atmospheres.

For instance, in the case of using the Si wafer as the target, a gaseous starting material for introducing oxygen atoms and, optionally, hydrogen atoms and/or halogen atoms is diluted as required with a dilution gas, introduced into a sputtering deposition chamber, gas plasmas with these gases are formed and the Si wafer is sputtered.

Alternatively, sputtering may be carried out in the atmosphere of a dilution gas or in a gas atmosphere containing at least hydrogen atoms(H) and/or halogen atoms(X) as constituent atoms as a sputtering gas by using individually Si and $SiO_2$ targets or a single Si and $SiO_2$ mixed target. As the gaseous starting material for introducing the oxygen atoms, the gaseous starting material for introducing the oxygen atoms as mentioned in the examples for the glow discharging process as described above can be used as the effective gas also in the sputtering.

Further, in the case of using the glow discharging process for forming the layer composed of a-Si containing carbon atoms, a mixture of gaseous starting material comprising silicon atoms(Si) as the constituent atoms, gaseous starting material comprising carbon atoms(C) as the constituent atoms and, optionally, gaseous starting material comprising hydrogen atoms(H) and/or halogen atoms(X) as the constituent atoms in a desired mixing ratio: a mixture of gaseous starting material comprising silicon atoms(Si) as the constituent atoms and gaseous starting material comprising carbon atoms (C) and hydrogen atoms(H) as the constituent atoms also in a desired mixing ratio: a mixture of gaseous starting material comprising silicon atoms(Si) as the constituent atoms and gaseous starting material comprising silicon atoms(Si), carbon atoms(C) and hydrogen atoms(H) as the constituent atoms: or a mixture of gaseous starting material comprising silicon atoms(Si) and hydrogen atoms(H) as the constituent atoms and gaseous starting material comprising carbon atoms(C) as constituent atoms are optionally used.

Those gaseous starting materials that are effectively usable herein can include gaseous silicon hydrides comprising C and H as the constituent atoms, such as silanese, for example, $SiH_4$, $Si_2H_6$, $Si_3H_8$ and $Si_4H_{10}$, as well as those comprising C and H as the constituent atoms, for example, saturated hydrocarbons of 1 to 4 carbon atoms, ethylenic hydrocarbons of 2 to 4 carbon atoms and acetylenic hydrocarbons of 2 to 3 carbon atoms.

Specifically, the saturated hydrocarbons can include methane ($CH_4$), ethane ($C_2H_6$, propane ($C_3H_8$), n-butane (n-$C_4H_{10}$) and pentane ($C_5H_{12}$), the ethylenic hydrocarbons can include ethylene ($C_2H_4$), propylene ($C_3H_6$), butene-1 ($C_4H_8$), butene-2 ($C_4H_8$), isobutylene ($C_4H_8$) and pentene ($C_5H_{10}$) and the acetylenic hydrocarbons can include acetylene ($C_2H_2$), methylacetylene ($C_3H_4$) and butine ($C_4H_6$).

The gaseous starting material comprising Si, C and H as the constituent atoms can include silicified alkyls, for example, $Si(CH_3)_4$ and $Si(C_2H_4$. In addition to these gaseous statting materials, $H_2$ can of course be used as the gaseous starting material for introducing H.

In the case of forming the layer composed of a-SiC(H,X) by way of the sputtering process, it is carried out by using a single crystal or polycrystalline Si wafer, a C (graphite) wafer or a wafer containing a mixture of Si and C as a target and sputtering them in a desired gas atmosphere.

In the case of using, for example, a Si wafer as a target, gaseous starting material for introducing carbon atoms, and hydrogen atoms and/or halogen atoms is introduced while being optionally diluted with a dilution gas such as Ar and He into a sputtering deposition chamber thereby forming gas plasmas with these gases and sputtering the Si wafer.

Alternatively, in the case of using Si and C as individual targets or as a single target comprising Si and C in admixture, gaseous starting material for introducing hydrogen atoms and/or halogen atom as the sputtering gas is optionally diluted with a dilution gas, introduced into a sputtering deposition chamber thereby forming gas plasmas and sputtering is carried out. As the gaseous starting material for introducing each of the atoms used in the sputtering process, those gaseous starting materials used in the glow discharging process as described above may be used as they are.

In the case of using the glow discharging process for forming the layer or the layer region containing the nitrogen atoms, starting material for introducing nitrogen atoms is added to the material selected as required from the starting materials for forming the light receiving layer as described above. As the starting material for introducing the nitrogen atoms, most of gaseous or gasifiable materials can be used that comprise at least nitrogen atoms as the constituent atoms.

For instance, it is possible to use a mixture of gaseous starting material comprising silicon atoms(Si) as the constituent atoms, gaseous starting material comprising nitrogen atoms(N) as the constituent atoms and, optionally, gaseous starting material comprising hydrogen atoms(H) and/or halogen atoms(X) as the constituent atoms mixed in a desired mixing ratio, or a mixture of starting gaseous material comprising silicon atoms(Si) as the constituent atoms and gaseous starting material comprising nitrogen atoms(N) and hydrogen atoms(H) as the constituent atoms also in a desired mixing ratio.

Alternatively, it is also possible to use a mixture of gaseous starting material comprising nitrogen atoms(N) as the constituent atoms gaseous starting material comprising silicon atoms(Si) and hydrogen atoms(H) as the constituent atoms.

The starting material that can be used effectively as the gaseous starting material for introducing the nitrogen atoms(N) used upon forming the layer or layer region containing nitrogen atoms can include gaseous or gasifiable nitrogen, nitrides and nitrogen compounds such as azide compounds comprising N as the constituent atoms or N and H as the constituent atoms, for example, nitrogen ($N_2$), ammonia ($NH_3$), hydrazine ($H_2NNH_2$), hydrogen azide ($HN_3$) and ammonium azide ($NH_4N_3$). In addition, nitrogen halide compounds such as nitrogen trifluoride ($F_3N$) and nitrogen tetrafluoride ($F_4N_2$) can also be mentioned in that they can also introduce halogen atoms(X) in addition to the introduction of nitrogen atoms(N).

The layer or layer region containing the nitrogen atoms may be formed through the sputtering process by using a single crystal or polycrystalline Si wafer or $Si_3N_4$ wafer or a wafer containing Si and $Si_3N_4$ in admixture as a target and sputtering them in various gas atmospheres.

In the case of using a Si wafer as a target, for instance, gaseous starting material for introducing nitrogen atoms and, as required, hydrogen atoms and/or halogen atoms is diluted optionally with a dilution gas, introduced into a sputtering deposition chamber to form gas plasmas with these gases and the Si wafer is sputtered.

Alternatively, Si and $Si_3N_4$ may be used as individual targets or as a single target comprising Si and $Si_3N_4$ in admixture and then sputtered in the atmosphere of a dilution gas or in a gaseous atmosphere containing at least hydrogen atoms(H) and/or halogen atoms(X) as the constituent atoms as for the sputtering gas. As the gaseous starting material for introducing nitrogen atoms, those gaseous starting materials for introducing the nitrogen atoms described previously as mentioned in the example of the glow discharging as above described can be used as the effective gas also in the case of the sputtering.

As mentioned above, the light receiving layer of the light receiving member of this invention is produced by the glow discharge process or sputtering process. The amount of germanium atoms and/or tin atoms; the group III atoms or group V atoms; oxygen atoms, carbon atoms, or nitrogen atoms; and hydrogen atoms and/or halogen atoms in the light receiving layer is controlled by regulating the gas flow rate of each of the starting materials or the gas flow ratio among the starting materials respectively entering the deposition chamber.

The conditions upon forming the photosensitive layer and the surface layer of the light receiving member of the invention, for example, the temperature of the support, the gas pressure in the deposition chamber, and the electric discharging power are important factors for obtaining the light receiving member having desired properties and they are properly selected while considering the functions of the layer to be made. Further, since these layer forming conditions may be varied depending on the kind and the amount of each of the atoms contained in the light receiving layer, the conditions have to be determined also taking the kind or the amount of the atoms to be contained into consideration.

For instance, in the case where the layer of a-Si(H,X) containing nitrogen atoms, oxygen atoms, carbon atoms, and the group III atoms or group V atoms, is to be formed, the temperature of the support is usually from 50° to 350° C. and, more preferably, from 50° to 250° C.; the gas pressure in the deposition chamber is usually from 0.01 to 1 Torr and, particularly preferably, from 0.1 to 0.5 Torr; and the electrical discharging power is usually from 0.005 to 50 W/cm$^2$, more preferably, from 0.01 to 30 W/cm$^2$ and, particularly preferably, from 0.01 to 20 W/cm$^2$.

In the case where the layer of a-SiGe(H,X) is to be formed or the layer of a-SiGe(H,X) containing the group III atoms or the group V atoms, is to be formed, the temperature of the support is usually from 50° to 350° C., more preferably, from 50° to 300° C., most preferably 100° to 300° C.; the gas pressure in the deposition chamber is usually from 0.01 to 5 Torr, more preferably, from 0.001 to 3 Torr, most preferably from 0.1 to 1 Torr; and the electrical discharging power is usually from 0.005 to 50 W/cm$^2$, more preferably, from 0.01 to 30 W/cm$^2$, most preferably, from 0.01 to 20 W/cm$^2$.

However, the actual conditions for forming the layer such as temperature of the support, discharging power and the gas pressure in the deposition chamber cannot usually be determined with ease independent of each other. Accordingly, the conditions optimal to the layer formation are desirably determined based on relative and organic relationships for forming the amorphous material layer having desired properties.

By the way, it is necessary that the foregoing various conditions are kept constant upon forming the light receiving layer for unifying the distribution state of germanium atoms and/or tin atoms, oxygen atoms, carbon atoms, nitrogen atoms, the group III atoms or group V atoms, or hydrogen atoms and/or halogen atoms to be contained in the light receiving layer according to this invention.

Further, in the case of forming the photosensitive layer containing germanium atoms and/or tin atoms, oxygen atoms, carbon atoms, nitrogen atoms, or the group III atoms or group V atoms at a desired distribution state in the direction of the layer thickness by varying their distribution concentration in the direction of the layer thickness upon forming the layer in this invention, the layer is formed, for example, in the case of the glow discharging process, by properly varying the gas flow rate of gaseous starting material for introducing germanium atoms and/or tin atoms, oxygen atoms, carbon atoms, nitrogen atoms, or the group III atoms or group V atoms upon introducing into the deposition chamber in accordance with a desired variation coefficient while maintaining other conditions constant. Then, the gas flow rate may be varied, specifically, by gradually changing the opening degree of a predetermined needle valve disposed to the midway of the gas flow system, for example, manually or any of other means usually employed such as in externally driving motor. In this case, the variation of the flow rate may not necessarily be linear but a desired content curve may be obtained, for example, by controlling the flow rate along with a previously designed variation coefficient curve by using a microcomputer or the like.

Further, in the case of forming the light receiving layer by way of the sputtering process, a desired distributed state of the germanium atoms and/or tin atoms, oxygen atoms, carbon atoms, nitrogen atoms, or the group III atoms or group V atoms in the direction of the layer thickness may be formed with the distribution density being varied in the direction of the layer thickness by using gaseous starting material for introducing the germanium atoms and/or tin atoms, oxygen atoms, carbon atoms, nitrogen atoms, or the group III atoms or group V atoms and varying the gas flow rate upon introducing these gases into the deposition chamber in accordance with a desired variation coefficient in the same manner as the case of using the glow discharging process.

Further, in the case of forming the surface layer in this invention with at least one of the elements selected from the inorganic fluorides, inorganic oxides and inorganic sulfides, since it is also necessary to control the layer thickness at an optical level for forming such a surface layer, vapor deposition, sputtering, gas phase plasma, optical CVD, heat CVD process or the like may be used. These forming processes are, of course, properly selected while considering those factors such as the kind of the forming materials for the surface layer, production conditions, installation cost required and production scale.

By the way, in view of the easy operations, easy setting for the conditions and the likes, sputtering process may preferably be employed in the case of using the inorganic compounds for forming the surface layer. That is, the inorganic compound for forming the surface layer is used as a target and Ar gas is used as a sputtering gas, and the surface layer is deposited by causing glow discharging and sputtering the inorganic compounds.

DESCRIPTION OF THE PREFERRED EMBODIMENTS

The invention will be described more specifically while referring to examples 1 through 26, but the invention is no way limited only to these examples.

Figure 25:
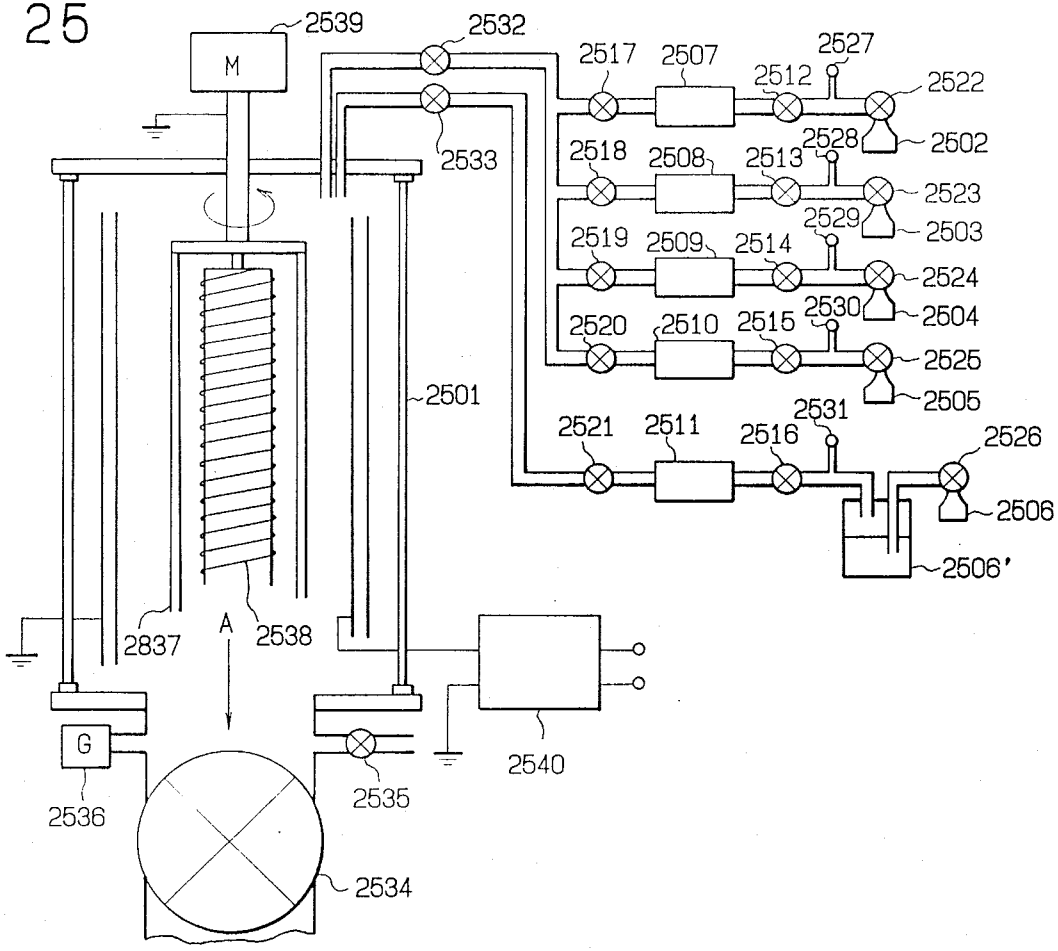
FIG. 25 is a schematic explanatory view of a fabrication device by glow discharging process as an example of the device for preparing the photosensitive layer and the surface layer respectively of the light receiving member according to this invention.

In each of the examples, the photosensitive layer was formed by using the glow discharging process and the surface layer was formed by using the glow discharging process or the sputtering process. FIG. 25 shows an apparatus for preparing a light receiving member according to this invention by means of the glow discharging process.

Gas reservoirs 2502, 2503, 2504, 2505, and 2506 illustrated in the figure are charged with gaseous starting materials for forming the respective layers in this invention, that is, for instance, $SiF_4$ gas (99.999% purity) in gas reservoir 2505, $B_2H_6$ gas (99.999% purity) diluted with $H_2$ (referred to as $B_2H_6/H_2$) in gas reservoir 2503, $CH_4$ gas (99.999% purity) in gas reservoir 2504, $GeF_4$ gas (99.999% purity) in gas reservoir 2505, and inert gas (He) in gas resorvoir 2506. $SnCl_4$ is held in a closed container 2506'.

Prior to the entrance of these gases into a reaction chamber 2501, it is confirmed that valves 2522–2526 for the gas cylinders 2502–2506 and a leak valve 1935 are closed and that inlet valves 2512–2516, exit valves 2517–2521, and sub-valves 2532 and 2533 are opened. Then, a main valve 2534 is at first opened to evacuate the inside of the reaction chamber 2501 and gas piping. Reference is made in the following to an example in the case of forming a first layer (photosensitive layer) then a second layer (surface layer) on a substrate Al cylinder 2537.

At first, $SiH_4$ gas from the gas reservoir 2502, $B_2H_6/H_2$ gas form the gas resorvoir 2503, and $GeF_4$ gas from the gas reservoir 2505 are caused to flow into mass flow controllers 2507, 2508, and 2510 respectively by opening the inlet valves 2512, 2513, and 2515, controlling the pressure of exit pressure gauges 2527, 2528, and 2530 to 1 kg/cm$^2$. Subsequently, the exit valves 2517, 2518, and 2520, and the sub-valve 2532 are gradually opened to enter the gases into the reaction chamber 2501. In this case, the exit valves 2517, 2518, and 2520 are adjusted so as to attain a desired value for the ratio among the $SiF_4$ gas flow rate, $GeF_4$ gas flow rate, and $B_2H_6/H_2$ gas flow rate, and the opening of the main valve 2534 is adjusted while observing the reading on the vacuum gauge 2536 so as to obtain a desired value for the pressure inside the reaction chamber 2501. Then, after confirming that the temperature of the substrate cylinder 2537 has been set by a heater 2538 within a range from 50° to 400° C., a power source 2540 is set to a predetermined electrical power to cause glow discharging in the reaction chamber 2501 while controlling the flow rates of $SiF_4$ gas, $GeF_4$ gas, and $B_2H_4/H_2$ gas in accordance with a previously designed variation coefficient curve by using a microcomputer (not shown), thereby forming, at first, the first layer containing silicon atoms, germanium atoms, and boron atoms on the substrate cylinder 2537. When the layer 102' has reached a desired thickness, the exit valves 2518 and 2520 are completely closed, and the glow discharge is continued in the same manner except that the discharge conditions are changed as required, whereby the second layer is formed on the first layer.

That is, subsequent to the procedures as described above, $SiF_4$ gas and $CH_4$ gas, for instance, are optionally diluted with a dilution gas such as He, Ar and $H_2$ respectively, entered at a desired gas flow rates into the reaction chamber 2501 while controlling the gas flow rate for the $SiF_4$ gas and the $CH_4$ gas in accordance with a previously designed variation coefficient curve by using a microcomputer and glow discharge being caused in accordance with predetermined conditions, by which a surface layer constituted with a-Si(H,X) containing carbon atoms is formed.

All of the exit valves other than those required for upon forming the respective layers are of course closed. Further, upon forming the respective layers, the inside of the system is once evacuated to a high vacuum degree as required by closing the exit valves 2517–2521 while opening the sub-valves 2532 and 2533 and fully opening the main valve 2534 for avoiding that the gases having been used for forming the previous layers are left in the reaction chamber 2501 and in the gas pipeways from the exit valves 2517–2521 to the inside of the reaction chamber 2501.

In the case where the first layer i.e. photosensitive layer is incorporated with tin atoms, and $SnCl_4$ is used as the feed gas, the starting material for tin atoms, solid $SnCl_4$ placed in 2506' is heated by a heating means (not shown) and an inert gas such as He is blown for bubbling from the inert gas reservoir 2506. The thus generated gas of $SnCl_4$ is introduced into the reaction chamber in the same manner as mentioned for $SiF_4$ gas, $GeF_4$ gas, $CH_4$ gas, and $B_2H_6/H_2$ gas.

In the case where the photosensitive layer is formed by glow discharge process as mentioned above and subsequently the surface layer of the inorganic material is formed thereon by the sputtering process, the valves for the feed gases and diluent gas used for the layer of amorphous material are closed, and then the leak valve 2535 is gradually opened so that the pressure in the deposition chamber is restored to the atxospheric pressure and the deposition chamber is scavenged with argon gas.

Then, a target of the inorganic material for the formation of the surface layer is spread all over the cathode (not shown), and the deposition chamber is evacuated, with the leak valve 2535 closed, and argon gas is introduced into the deposition chamber until a pressure of 0.015 to 0.02 Torr is reached. A high-frequency power (150 to 170W) is applied to bring about glow discharge, whereby sputtering the inorganic material so that the surface layer is deposited on the previously formed layer.

TEST EXAMPLE 1

Rigid spheres of 0.6 mm diameter made of SUS stainless steels were chemically etched to form an unevenness to the surface of each of the rigid spheres.

Usable as the etching agent are an acid such as hydrochloric acid, hydrofluoric acid, sulfuric acid and chromic acid and an alkali such as caustic soda.

In this example, an aqueous solution prepared by admixing 1.0 volumetric part of concentrated hydrochloric acid to 1.0 to 4.0 volumetric part of distilled water was used, and the period of time for the rigid spheres to be immersed in the aqueous solution, the acid concentration of the aqueous solution and other necessary conditions were appropriately adjusted to form a desired unevenness to the surface of each of the rigid spheres.

TEST EXAMPLE 2

In the device as shown in FIGS. 6(A) and 6(B), the surface of an aluminum alloy cylinder (diameter: 60 mm, length: 298 mm) was treated by using the rigid spheres each of which having a surface provided with appropriate minute irregularities (average height of the irregularities $\gamma_{max}=5$ μm) which were obtained in Test Example 1 to have an appropriate uneven shape composed of dimples each of which having an inside face provided with irregularities.

When examining the relationship for the diameter R' of the rigid sphere, the falling height h, the radius of curvature R and the width D for the dimple, it was confirmed that the radius of curvature R and the width D of the dimple was determined depending on the conditions such as the diameter R' for the rigid sphere, the falling height h and the like. It was also confirmed that the pitch between each of the dimples (density of the dimples or the pitch for the unevenness) could be adjusted to a desired pitch by controlling the rotating speed or the rotation number of the cylinder, or the falling amount of the rigid sphere.

Further, the following matters were confirmed as a result of the studies about the magnitude of R and of D; it is not preferred for R to be less than 0.1 mm because the rigid spheres to be employed in that case are to be lighter and smaller, that results in making it difficult to control the formation of the dimples as expected. Then, it is not preferred for R to be more than 2.0 mm because the rigid spheres to be employed in that case are to be heavier and the falling height is to be extremely lower, for instance, in the case where D is desired to be relatively smaller in order to adjust the falling height, that results in making it also difficult to control the formation of the dimples as expected. Further, it is not preferred for D to be less than 0.02 mm because the rigid spheres to be employed in that case are to be of a smaller size and to be lighter in order to secure their falling height, that results in making it also difficult to control the formation of the dimples as expected. Further in addition, when examining the dimples as formed, it was confirmed that the inside face of each of the dimples as formed was provided with appropriate minute irregularities.

EXAMPLE 1

The surface of an aluminum alloy cylinder was fabricated in the same manner as in the Test Example 2 to obtain a cylindrical Al support having diameter D and ratio D/R (cylinder Nos. 101 to 106) shown in the upper column of Table 1A.

Then, a light receiving layer was formed on each of the Al supports (cylinder Nos. 101 to 106) under the conditions shown in Tables A and B as below shown using the fabrication device shown in FIG. 25.

Figure 26:
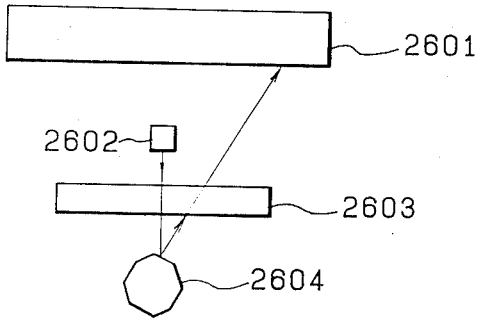
FIG. 26 is a view for illustrating the image exposing device by the laser beams.
Figure 26:
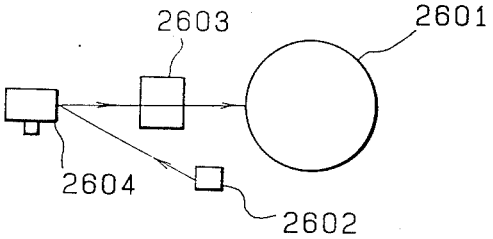

These light receiving members were subjected to imagewise exposure by irradiating laser beams at 780 nm wavelength and with 80 μm spot diameter using an image exposing device shown in FIG. 26 and images were obtained by subsequent development and transfer. The state of the occurrence of interference fringe on the thus obtained images were as shown in the lower row of Table 1A.

FIG. 26(A) is a schematic plan view illustrating the entire exposing device, and FIG. 26(B) is a schematic side elevational view for the entire device. In the figures, are shown a light receiving member 2601, a semiconductor laser 2602, an fθ lens 2603, and a polygonal mirror 2604.

Then as a comparison, a light receiving member was manufactured in the same manner as described above by using an aluminum alloy cylinder (No. 107), the surface of which was fabricated with a conventional cutting tool (60 mm in diameter, 298 mm in length, 100 μm unevenness pitch, and 3 μm unevenness depth). When observing the thus obtained light receiving member under an electron microscope, the layer interface between the support surface and the light receiving layer and the surface of the light receiving layer were in parallel with each other. Images were formed in the same manner as above by using this light receiving member and the thus obtained images were evaluated in the same manner as described above. The results are as shown in the lower row of Table 1A.

TABLE 1A

| Cylinder No. | 101 | 102 | 103 | 104 | 105 | 106 | 107 |
|---|---|---|---|---|---|---|---|
| D (μm) | 450 ± 50 | 450 ± 50 | 450 ± 50 | 450 ± 50 | 450 ± 50 | 450 ± 50 | — |
| D/R | 0.02 | 0.03 | 0.04 | 0.05 | 0.06 | 0.07 | — |
| Occurrence of interference fringes | x | Δ | ○ | ○ | ◎ | ◎ | x |

Actual usability:◎: excellent, ○: good, Δ: fair, x: poor

EXAMPLE 2

A light receiving layer was formed on each of the Al supports (cylinder Nos. 101 to 107) in the same manner as in Example 1 except for forming these light receiving layers in accordance with the layer forming conditions as shown in Tables A and B.

Images were formed on the thus obtained light receiving members in the same manner as in Example 1. Occurrence of interference fringe was as shown in the lower row of Table 2A.

TABLE A

| Example No. | Photosensitive layer: Charge injection inhibition layer | | Surface layer: Reflection preventive layer (inside layer) from the side of the support: 1st layer | 2nd layer | 3rd layer | Abrasion-resistant layer (outermost layer) |
|---|---|---|---|---|---|---|
| 1 | — | 19 | 2 | — | — | 3 |
| 2 | — | 19 | 8 | — | — | 5 |
| 3 | — | 20 | 12 | — | — | 5 |
| 4 | — | 20 | 12 | — | — | 16 |
| 5 | — | 20 | 12 | 13 | — | 3 |
| 6 | — | 20 | 12 | 13 | 4 | 1 |
| 7 | — | 17 | 4 | — | — | 1 |
| 8 | — | 18 | 4 | — | — | 1 |
| 9 | 26 | 20 | 6 | — | — | 7 |
| 10 | 27 | 20 | 4 | — | — | 9 |
| 11 | 28 | 20 | 4 | — | — | 10 |
| 12 | — | 20 | 4 | — | — | 11 |
| 13 | 26 | 20 | 13 | — | — | 2 |
| 14 | 26 | 20 | 14 | — | — | 2 |
| 15 | 26 | 20 | 15 | — | — | 2 |
| 16 | 26 | 20 | 14 | 15 | — | 2 |
| 17 | 26 | 20 | 14 | 15 | 4 | 2 |
| 18 | — | 21 | 4 | — | — | 1 |
| 19 | 29 | 21 | 4 | — | — | 1 |
| 20 | 30 | 22 | 4 | — | — | 1 |
| 21 | — | 25 | 2 | — | — | 3 |
| 22 | 31 | 23 | 8 | — | — | 5 |
| 23 | 32 | 24 | 6 | — | — | 7 |
| 24 | 33 | 23 | 4 | — | — | 9 |
| 25 | 34 | 23 | 4 | — | — | 1 |
| 26 | 35 | 25 | 4 | — | — | 1 |

Numerals in the table represent the layer No. shown in Table B.

TABLE 2A

| Cylinder No. | 101 | 102 | 103 | 104 | 105 | 106 | 107 |
|---|---|---|---|---|---|---|---|
| D (μm) | 450 ± 50 | 450 ± 50 | 450 ± 50 | 450 ± 50 | 450 ± 50 | 450 ± 50 | — |
| D/R | 0.02 | 0.03 | 0.04 | 0.05 | 0.06 | 0.07 | — |
| Occurrence of interference fringes | x | Δ | ○ | ○ | ◎ | ◎ | x |

Actual usability:◎: excellent, ○: good, Δ: fair, x: poor

EXAMPLES 3 to 26

A light receiving layer was formed on each of the Al supports (Cylinder Nos. 103 to 106) in the same manner as in Example 1 except for forming these light receiving layers in accordance with the layer forming conditions shown in Tables A and B.

Images were formed on the thus obtained light receiving members in the same manner as in Example 1. Occurrence of interference fringe was not observed in any of the thus obtained images and the image quality was extremely high.

TABLE B

| Name of layer | Layer No. | Preparing Method GD: Glow Discharge SP: Sputtering | Layer constituent material | Preparing condition: Gas used and flow rate, or target and sputter gas used (SCCM) | | | Layer thickness (μ) |
|---|---|---|---|---|---|---|---|
| Surface layer | 1 | GD | a-SiCH | $SiH_4$ | gas | 10 | 2 |
| | 2 | | | $CH_4$ | gas | 600 | 0.14 |
| | 3 | GD | a-SiCH | $SiH_4$ | gas | 100 | 3 |
| | 4 | | | $CH_4$ | gas | 300 | 0.076 |
| | 5 | | | $SiH_4$ | gas | 10 | 1 |
| | 6 | GD | a-SiCHF | $SiF_4$ | gas | 10 | 0.12 |
| | | | | $CH_4$ | gas | 700 | |
| | 7 | | | $SiH_4$ | gas | 70 | 1.5 |
| | 8 | GD | a-SiCHF | $SiF_4$ | gas | 70 | 0.11 |
| | | | | $CH_4$ | gas | 300 | |
| | 9 | GD | a-SiNOH | $SiH_4$ | gas | 150 | 2.5 |
| | | | | $N_2O$ | gas | 300 | |
| | 10 | GD | a-SiNH | $SiH_4$ | gas | 100 | 2 |
| | | | | $NH_3$ | gas | 300 | |
| | 11 | GD | a-SiNHF | $SiH_4$ | gas | 70 | 2 |
| | | | | $SiF_4$ | gas | 70 | |
| | | | | $NH_3$ | gas | 250 | |
| | 12 | SP | $Al_2O_3$ | $Al_2O_3$ | | | 0.36 |

TABLE B-continued

| Name of layer | Layer No. | Preparing Method GD: Glow Discharge SP: Sputtering | Layer constituent material | Preparing condition: Gas used and flow rate, or target and sputter gas used (SCCM) | | | Layer thickness (μ) |
|---|---|---|---|---|---|---|---|
| | | | | Al | gas | | |
| | 13 | SP | $SiO_2$ | $SiO_2$ | | | 0.39 |
| | | | | Ar | gas | | |
| | 14 | SP | $Al_2O_3/ZrO_2 = 1/1$ | $Al_2O_3/ZrO_2 = 1/1$ | | | 0.35 |
| | | | | Ar | gas | | |
| | 15 | SP | $TiO_2$ | $TiO_2$ | | | 0.26 |
| | | | | Ar | gas | | |
| | 16 | SP | $SiO_2$ | $SiO_2$ | | | 1 |
| | | | | Ar | gas | | |
| Photosensitive layer | 17 | GD | a-SiGeH | $SiH_4$ | gas | 300 | 25 |
| | | | | $GeH_4$ | gas | 50 | |
| | | | | $H_2$ | gas | 360 | |
| | 18 | GD | a-SiGeHF | $SiH_4$ | gas | 150 | 20 |
| | | | | $SeF_4$ | gas | 50 | |
| | | | | $SiF_4$ | gas | 150 | |
| | | | | $H_2$ | gas | 350 | |
| | 19 | GD | a-SiGeHB | $SiH_4$ | gas | 300 | 18 |
| | | | | $GeH_4$ | gas | 50 | |
| | | | | $H_2$ | gas | 360 | |
| | | | | $B_2H_6$ | gas | $3.5 \times 10^{-4}$ | |
| | 20 | GD | a-SiGeHFB | $SiF_4$ | gas | 250 | 15 |
| | | | | $GeF_4$ | gas | 50 | |
| | | | | $H_2$ | gas | 250 | |
| | | | | $BF_3$ | gas | $3.5 \times 10^{-4}$ | |
| | 21 | GD | a-SiGeNHB | $SiH_4$ | gas | 250 | 15 |
| | | | | $GeH_4$ | gas | 50 | |
| | | | | $H_2$ | gas | 250 | |
| | | | | $NH_3$ | gas | $2.5 \times 10^{-1}$ | |
| | | | | $B_2H_6$ | gas | $3.5 \times 10^{-4}$ | |
| | 22 | GD | a-SiGeNOHB | $SiH_4$ | gas | 250 | 15 |
| | | | | $GeH_4$ | gas | 50 | |
| | | | | $H_2$ | gas | 250 | |
| | | | | NO | gas | $2.5 \times 10^{-1}$ | |
| | | | | $B_2H_6$ | gas | $3.5 \times 10^{-4}$ | |
| | 23 | GD | a-SiH | $SiH_4$ | gas | 350 | 25 |
| | | | | $H_2$ | gas | 360 | |
| | 24 | GD | a-SiHF | $SiH_4$ | gas | 200 | 20 |
| | | | | $SiF_4$ | gas | 150 | |
| | | | | $H_2$ | gas | 350 | |
| | 25 | GD | a-SiSnH | $SiH_4$ | gas | 300 | 20 |
| | | | | $SnCl_4$ | gas | 20 | |
| Charge injection inhibition layer | 26 | GD | a-SiGeHB | $SiH_4$ | gas | 300 | 5 |
| | | | | $GeH_4$ | gas | 50 | |
| | | | | $H_2$ | gas | 360 | |
| | | | | $B_2H_6$ | gas | $4.0 \times 10^{-2}$ | |
| | 27 | GD | a-SiGeHFB | $SiH_4$ | gas | 250 | 3 |
| | | | | $SiF_4$ | gas | 100 | |
| | | | | $GeF_4$ | gas | 50 | |
| | | | | $H_2$ | gas | 150 | |
| | | | | $B_2H_6$ | gas | $6.0 \times 10^{-2}$ | |
| | 28 | GD | a-SiGeHFB | $SiH_4$ | gas | 200 | 3.5 |
| | | | | $SiF_4$ | gas | 150 | |
| | | | | $GeF_4$ | gas | 50 | |
| | | | | $BF_3$ | gas | $6.0 \times 10^{-2}$ | |
| | 29 | GD | a-SiGeHNB | $SiH_4$ | gas | 300 | 5 |
| | | | | $GeH_4$ | gas | 50 | |
| | | | | $H_2$ | gas | 360 | |
| | | | | $NH_3$ | gas | 10 | |
| | | | | $B_2H_6$ | gas | $4.0 \times 10^{-2}$ | |
| | 30 | GD | a-SiGeNOHB | $SiH_4$ | gas | 300 | 5 |
| | | | | $GeH_4$ | gas | 50 | |
| | | | | $H_2$ | gas | 360 | |
| | | | | NO | gas | 10 | |
| | | | | $B_2H_6$ | gas | $4.0 \times 10^{-2}$ | |
| | 31 | GD | a-SiGeHB | $SiH_4$ | gas | 50 | 5 |
| | | | | $GeH_4$ | gas | 300 | |
| | | | | $H_2$ | gas | 360 | |
| | | | | $B_2H_6$ | gas | $4.0 \times 10^{-2}$ | |
| | 32 | GD | a-SiGeHFB | $SiH_4$ | gas | 50 | 3 |
| | | | | $GeF_4$ | gas | 300 | |
| | | | | $H_2$ | gas | 300 | |
| | | | | $B_2H_6$ | gas | $6.0 \times 10^{-2}$ | |
| | 33 | GD | a-SiGeNHB | $SiH_4$ | gas | 50 | 5 |
| | | | | $GeH_4$ | gas | 300 | |
| | | | | $H_2$ | gas | 360 | |
| | | | | $NH_3$ | gas | 10 | |
| | | | | $B_2H_6$ | gas | $4.0 \times 10^{-2}$ | |

TABLE B-continued

| Name of layer | Layer No. | Preparing Method GD: Glow Discharge SP: Sputtering | Layer constituent material | Preparing condition: Gas used and flow rate, or target and sputter gas used (SCCM) | | | Layer thickness (μ) |
|---|---|---|---|---|---|---|---|
| | 34 | GD | a-SiGeNOHB | $SiH_4$ | gas | 50 | 5 |
| | | | | $GeH_4$ | gas | 300 | |
| | | | | $H_2$ | gas | 360 | |
| | | | | NO | gas | 10 | |
| | | | | $B_2H_6$ | gas | $4.0 \times 10^{-2}$ | |
| | 35 | GD | a-SiSnHB | $SiH_4$ | gas | 300 | 5 |
| | | | | $SnCl_4$ | gas | 20 | |
| | | | | $B_2H_6$ | gas | $4.0 \times 10^{-2}$ | |

What is claimed is:

1. A light receiving member comprising a support and a light receiving layer comprising a photosensitive layer and a surface layer having a free surface; said support having a surface provided with irregularities composed of spherical dimples, each of said dimples having an inside face provided with minute irregularities; said photosensitive layer being composed of amorphous material containing silicon atoms and at least one selected form the group consisting of germanium atoms and tin atoms; said surface layer being multi-layered and having at least a reflection preventinve layer in the inside and an abrasion-resistant layer at the outermost side; and said reflection prevention layer and said abrasin-resistant layer having different refractive indices.

2. The light receiving member as defined in claim 1 wherein the irregularities on the surface of the support are composed of spherical dimples having the same radius of curvature and the same width.

3. The light receiving member as defined in claim 1 wherein the irregularities on the surface of the support are formed by the impact of a plurality of rigid spheres on the surface of the support, each of said spheres having a surface provided with minute irregularities.

4. The light receiving member as defined in claim 3 wherein the irregularities on the surface of the support are formed by the impact of rigid shperes of approximately the same diameter falling spontaneously on the surface of the support from approximately the same height.

5. The light receiving member as defined in claim 1 wherein the spherical dimples have a radius of curvature R and a width D which satisfy the following equation:

$$0.035 \leqq D/R \leqq 0.5$$

6. The light receiving member as defined in claim 2 wherein the spherical dimples having the width D satisfy the following equation:

$$D \leqq 0.5 \text{ m}$$

7. The light receiving member as defined in claim 1 wherein the minute irregularities have a height h which satisfies the following equation:

$$0.5\ \mu m \leqq h \leqq 20\ \mu m$$

8. The light receiving member as defined in claim 1 wherein the support is a metal body.

9. The light receiving member as defined in claim 1 wherein the photosensitive layer contains 1 to $6 \times 10^5$ atomic ppm of the germanium atoms distributed uniformly or nonuniformly in the thickness direction in the entire layer or in a portion of the layer.

10. The light receiving member as defined in claim 1 wherein the photosensitive layer contains 1 to $6 \times 10^5$ atomic ppm of the tin atoms distributed uniformly or nonuniformly in the thickness direction in the entire layer or in a portion of the layer.

11. The light receiving member as defined in claim 1 wherein the photosensitive layer contains both the germanium atoms and the tim atoms in a total amount of 1 to $6 \times 10^5$ atomic ppm distrubuted uniformly or nonuniformly in the thickness direction in the entire layer or in a portion of the layer.

12. The light receiving member as defined in claim 1 wherein the photosensitive layer contains at least one selected from the group consisting of hydrogen atoms and halogen atoms.

13. The light receiving member as defined in claim 12 wherein the photosensitive layer contains 1 to 40 atomic % of the hydrogen atoms.

14. The light receiving member as defined in claim 12 wherein the phtosensitive layer contains 1 to 40 atomic % of the halogen atoms.

15. The light receiving member as defined in claim 12 wherein the photosensitive layer contains both the hydrogen atoms and the halogen atoms in a total amount of 1 to 40 atomic %.

16. The light receiving member as defined in claim 1 wherein the photosensitive layer contains at least one selected from the group consisting of oxygen atoms, carbon atoms and nitrogen atoms in an amount of 0.001 to 50 atomic % distributed uniformly or nonuniformly in the thickness direction.

17. The light receiving member as defined in claim 1 wherein the photosensitive layer contains a conductivity controlling substnace in an amount of $1 \times 10^{-3}$ to to $1 \times 10^3$ atomic ppm distributed uniformly or nonuniformly in the thickness direction in the entire layer or in a portion of the layer.

18. The light receiving memberas defined in claim 17 wherein the conductivity controlling substance is a member selected from the group consisting of Group III elements and Group V elements of the Periodic Table.

19. The light receiving member as defined in claim 1 wherein the thickness of the photosensitive layer is 1 to 100 μm.

20. The light receiving member as defined in claim 1 wherein the photosensitive layer is multi-layered.

21. The light receiving member as defined in claim 20 wherein the photosensitive layer includes a charge injection inhibition layer containing a conductivity controlling substance selected from the group consisting of Group III elements and Group V elements of the Periodic Table.

22. The light receiving member as defined in claim 21 wherein the charge injection inhibition layer is situated adjacent to the support.

23. The light receiving member as defined in claim 22 wherein the relation between the thickness (t) of the charge injection inhibition layer and the entire thickness (T) of the light receiving layer satisfies the equation: $t/T \leqq 0.4$.

24. The light receiving member as defined in claim 23 wherein the thickness (t) of the charge injection inhibition layer is $3\times10^{-3}$ to 10 μm.

25. The light receiving member as defined in claim 20 wherein the photosensitive layer includes a barrier layer composed of a material selected from the group consisting of $Al_2O_3$, $SiO_2$, $Si_3N_4$ and polycarbonate.

26. The light receiving member as defined in claim 20 wherein the photosensitive layer includes (a) a barrier layer composed of a material selected from the group of $Al_2O_3$, $SiO_2$, $Si_3N_4$ and polycarbonate and (b) a charge injection inhibition layer containing a conductivity controlling substance selected from the group consisting of Group III elements and Group V elements of the Periodic Table.

27. The light receiving member as defined in claim 1 wherein the thickness of the surface layer is $3\times10^{-3}$ to 30 μm.

28. The light receiving member as defined in claim 1 wherein the reflection preventive layer and the abrasion-resistant layer satisfy the following equation (1) and (2):

$$n_3 = \sqrt{n_1 \cdot n_2} \text{ (where } n_1 < n_3 < n_2) \quad (1)$$

$$2n_3d = (\tfrac{1}{2} + m)\lambda \quad (2)$$

wherein m is an integer, $n_1$ is a refractive index of the photosensitive layer, $n_2$ is a refractive index of the abrasion-resistant layer, $n_3$ is a refractive index of the reflection preventive layer, d is a thickness of the reflection preventive layer and λ is a wavelength of the incident light.

29. The light receiving member as defined in claim 1 wherein the reflection preventive layer is composed of an amorphous material containing silicon atoms and at least one selected from the group consisting of oxygen atoms, carbon atoms and nitrogen atoms.

30. The light receiving member as defined in claim 29 wherein said amorphous material further contains at least one selected from the group consisting of hydrogen atoms and halogen atoms.

31. The light receiving member as defined in claim 1 wherein the reflection preventive layer is composed of an inorganic material selected from the group consisting of $MgF_2$, $Al_2O_3$, $ZnO_2$, $TiO_2$, ZnS, $CeO_2$, $CeF_3$, $Ta_2O_5$, $AlF_3$ and NaF.

32. The light receiving member as defined in claim 1 wherein the abrasion-resistant layer is composed of an amorphous material containing silicon atoms and at least one selected from the group consisting of oxygen atoms, carbon atoms and nitrogen atoms.

33. The light receiving member as defined in claim 32 wherein said amorphous material further contains at least one selected from the group consisting of hydrogen atoms and halogen atoms.

34. The light receiving member as defined in claim 1 wherein the abrasion-resistant layer is composed of an inorganic material selected from the group consisting of $MgF_2$, $Al_2O_3$, $ZnO_2$, $TiO_2$, ZnS, $CeO_2$,$CeF_3$, $Ta_2O_5$, $AlF_3$ and NaF.

35. An electrophotographic process comprising:

(a) applying an electric field to the light receiving member of claim 1; and (b) applying an electromagnetic wave to said light receiving member thereby forming an electrostatic image.

* * * * *

UNITED STATES PATENT AND TRADEMARK OFFICE

CERTIFICATE OF CORRECTION

PATENT NO. : 4,797,336

DATED : January 10, 1989

INVENTOR(S) : MITSURU HONDA, ET AL.

It is certified that error appears in the above-identified patent and that said Letters Patent is hereby corrected as shown below:

ON TITLE PAGE:

IN [57] ABSTRACT

Line 18, "possible" should read --possibly--.

SHEET 14

FIG. 25, "2837" should read --2537--.

COLUMN 2

Line 8, "as having" should read --having--.
Line 22, "th.e" should read --the--.

COLUMN 3

Line 37, "all," should be deleted.

COLUMN 4

Line 28, "cause" should read --causes--.
Line 39, "Other" should read --Another--.
Line 49, "layers,strict" should read --layers, strict--.

COLUMN 5

Line 31, "germaniums" should read --germanium--.

UNITED STATES PATENT AND TRADEMARK OFFICE

CERTIFICATE OF CORRECTION

PATENT NO. : 4,797,336

DATED : January 10, 1989

INVENTOR(S) : MITSURU HONDA, ET AL.

It is certified that error appears in the above-identified patent and that said Letters Patent is hereby corrected as shown below:

COLUMN 6

Line 2, "follows;" should read --follows.--.
Line 40, "infringe" should read --fringe--.
Line 58, "multilayered" should read --multi-layered--.

COLUMN 7

Line 27, "dispersed. within" should read --dispersed within--.
Line 34, "fringe" should read --interference fringe--.
Line 35, "resulted" should read --resulting--.
Line 38, "support thereby" should read --support causing dispersion thereof thereby--.

COLUMN 8

Line 15, "out.various" should read --out various--.
Line 36, "ueven-" should read --uneven- --.
Line 46, "not be" should read --not--.
Line 66, "materia" should read --material--.

COLUMN 9

Line 17, "mateiral" should read --material
Line 26, "refection" should read --reflection--.
Line 54, "adn" should read --and--.

UNITED STATES PATENT AND TRADEMARK OFFICE

CERTIFICATE OF CORRECTION

PATENT NO. : 4,797,336

DATED : January 10, 1989

INVENTOR(S) : MITSURU HONDA, ET AL.

It is certified that error appears in the above-identified patent and that said Letters Patent is hereby corrected as shown below:

COLUMN 10

Line 2, "tee" should read --the--.
Line 19, "rigid.sphere" should read --rigid sphere--.

COLUMN 11

Line 12, "reduce" should read --reduces--.
Line 58, "then" should read --now--.

COLUMN 12

Line 10, "Axong" should read --Among--.
Line 25, "sating" should read --satin--.
Line 64, "are" should read --is--.
Line 65, "lllow" should read --allow--.

COLUMN 14

Line 18, "distributingconcentration" should read --distributing concentration--.
Line 47, "represent" should read --represents--.

COLUMN 15

Line 4, "in such" should read --is such--.
Line 30, "uuch" should read --such--.
Line 46, "poistion" should read --position--.

--

UNITED STATES PATENT AND TRADEMARK OFFICE

CERTIFICATE OF CORRECTION

PATENT NO. : 4,797,336

DATED : January 10, 1989

INVENTOR(S) : MITSURU HONDA, ET AL.

It is certified that error appears in the above-identified patent and that said Letters Patent is hereby corrected as shown below:

COLUMN 16

Line 17, "ther" should read --the--.

COLUMN 17

Line 61, "distributoon" should read --distribution--.

COLUMN 18

Line 55, "contained to" should read --contained in--.
Line 67, ",AAl" should read --, Al--.

COLUMN 19

Line 44, "photo-sensitive" should read --photosensitive--.

COLUMN 20

Line 34, "th" should read --the--.
Line 59, "constitued" should read --constituted--.
Line 65, "provide" should read --provides--.

COLUMN 21

Line 7, "atoms(X)." should read --atoms(X)--.

UNITED STATES PATENT AND TRADEMARK OFFICE

CERTIFICATE OF CORRECTION

PATENT NO. : 4,797,336

DATED : January 10, 1989

INVENTOR(S) : MITSURU HONDA, ET AL.

It is certified that error appears in the above-identified patent and that said Letters Patent is hereby corrected as shown below:

COLUMN 22

Line 51, "exempliefied" should read --exemplified--.

COLUMN 23

Line 62, "geenrated" should read --generated--.

COLUMN 24

Line 10, "chlorine bromine," should read --chlorine, bromine,--.
Line 26, "material" should read --materials--.
Line 43, "are" should read --as--.
Line 52, "atxosphere" should read --atmosphere--.

COLUMN 27

Line 10, "comprse" should read --comprise--.
Line 28, "atoms(si)" should read --atoms(Si)--.
Line 36, "pentaxide" should read --pentoxide--.

COLUMN 28

Line 28, "($C_2H_6$," should read --($C_2H_6$),--.
Line 37, "Si($C_2H_4$." should read --Si($C_2H_5$)$_4$.--.
Line 38, "statting" should read --starting--.

UNITED STATES PATENT AND TRADEMARK OFFICE

CERTIFICATE OF CORRECTION

PATENT NO. : 4,797,336

DATED : January 10, 1989

INVENTOR(S) : MITSURU HONDA, ET AL.

It is certified that error appears in the above-identified patent and that said Letters Patent is hereby corrected as shown below:

COLUMN 31

Line 40, "likes," should read --like,--.
Line 65, "2505," should read --2502,--.

COLUMN 32

Line 5, "1935" should read --2535--.
Line 14, "$SiH_4$" should read --$SiF_4$--.
Line 15, "form" should read --from--.
Line 50, "rates" should read --rate--.
Line 59, "upon" should be deleted.

COLUMN 33

Line 17, "atxospheric" should read --atmospheric--.

COLUMN 38

Line 17, "$SeF_4$" should read --$SiF_4$--.

COLUMN 39

Line 24, "form" should read --from--.
Line 26, "preventinve" should read --preventive--.
Lines 28-29, "abrasin-resistant" should read --abrasion-resistant--.
Line 41, "shperes" should read --spheres--.
Line 55, "$D \leqq 0.5$ m" should read --$D \leqq 0.5$ mm--.

UNITED STATES PATENT AND TRADEMARK OFFICE

CERTIFICATE OF CORRECTION

PATENT NO. : 4,797,336

DATED : January 10, 1989

INVENTOR(S) : MITSURU HONDA, ET AL.

It is certified that error appears in the above-identified patent and that said Letters Patent is hereby corrected as shown below:

COLUMN 40

Line 22, "tim" should read --tin--.
Line 23, "distrubuted" should read --distributed--.
Line 49, "substnace" should read --substance-- and "to to" should read --to--.
Line 53, "memberas" should read --member as--.

Signed and Sealed this

Third Day of December, 1991

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,797,336

DATED : January 10, 1989

INVENTOR(S) : Mitsuru Honda, et al

It is certified that error appears in the above-identified patent and that said Letters Patent is hereby corrected as shown below:

COLUMN 39

Line 55, "D≦0.5 m" should read --D≦0.5 mm--.

Signed and Sealed this

Tenth Day of March, 1992

*Attest:*

HARRY F. MANBECK, JR.

*Attesting Officer*

*Commissioner of Patents and Trademarks*